US011599053B2

(12) United States Patent
Midorikawa

(10) Patent No.: US 11,599,053 B2
(45) Date of Patent: Mar. 7, 2023

(54) SHEET CONVEYING DEVICE AND IMAGE FORMING APPARATUS INCORPORATING THE SHEET CONVEYING DEVICE

(71) Applicant: Ruki Midorikawa, Kanagawa (JP)

(72) Inventor: Ruki Midorikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 16/878,332

(22) Filed: May 19, 2020

(65) Prior Publication Data

US 2020/0387102 A1 Dec. 10, 2020

(30) Foreign Application Priority Data

Jun. 10, 2019 (JP) ..... JP2019-107973
Jan. 10, 2020 (JP) ..... JP2020-002584

(51) Int. Cl.
*B65H 29/60* (2006.01)
*G03G 15/00* (2006.01)
(Continued)

(52) U.S. Cl.
CPC ..... *G03G 15/6552* (2013.01); *B65H 5/062* (2013.01); *B65H 5/085* (2013.01); *G03G 21/206* (2013.01); *B65H 5/066* (2013.01)

(58) Field of Classification Search
CPC ..... G03G 15/6552; G03G 21/206; G03G 15/2017; G03G 15/2021; G03G 15/6573;
(Continued)

(56) References Cited

U.S. PATENT DOCUMENTS

2007/0059024 A1* 3/2007 Kitayama ..... G03G 15/2039 399/92
2010/0232846 A1* 9/2010 Watanabe ..... G03G 15/2028 399/341
(Continued)

FOREIGN PATENT DOCUMENTS

JP 2001-255807 9/2001
JP 2007-58077 * 3/2007
(Continued)

OTHER PUBLICATIONS

Machine translation of JP2007-58077 (Year: 2007).*

*Primary Examiner* — Thomas A Morrison
(74) *Attorney, Agent, or Firm* — Duft & Bornsen, PC

(57) ABSTRACT

A sheet conveying device includes a first duct, a second duct, and a switching member. The first duct is disposed at a first side of a sheet conveyance passage to face a first face of a sheet passing the sheet conveyance passage and has a first air blowing port through which air is blown toward the sheet conveyance passage. The second duct is disposed at a second side of the sheet conveyance passage to face a second face of the sheet passing the sheet conveyance passage and has a second air blowing port through which air is blown toward the sheet conveyance passage. The switching member is disposed downstream from the first and second air blowing ports in a sheet conveyance direction and configured to switch the sheet conveyance passage. No pair of rollers is disposed between the switching member and each of the first and second blowing ports.

20 Claims, 13 Drawing Sheets

(51) Int. Cl.
*B65H 5/06* (2006.01)
*B65H 5/08* (2006.01)
*G03G 21/20* (2006.01)

(58) Field of Classification Search
CPC ..... G03G 15/00; G03G 21/20; B65H 5/062; B65H 5/085; B65H 5/066; B65H 29/60
USPC ..... 399/341, 92
See application file for complete search history.

(56) References Cited

U.S. PATENT DOCUMENTS

2011/0081176 A1* 4/2011 Masuda ..... B65H 29/125 399/341
2012/0114402 A1* 5/2012 Hatazaki ..... G03G 15/6573 399/341
2012/0288296 A1* 11/2012 Endo ..... G03G 15/6576 399/71
2014/0161481 A1* 6/2014 Udagawa ..... G03G 21/206 399/92
2015/0338796 A1* 11/2015 Koga ..... G03G 15/2025 399/341
2017/0235264 A1 8/2017 Midorikawa et al.
2019/0248609 A1 8/2019 Midorikawa
2019/0302690 A1 10/2019 Midorikawa

FOREIGN PATENT DOCUMENTS

JP 2010-215311 9/2010
JP 2011-051676 3/2011
JP 2012-053341 3/2012
JP 2017-129806 7/2017

* cited by examiner

| FIG. 13A |
| --- |
| FIG. 13B |

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2019-107973, filed on Jun. 10, 2019, and 2020-002584, filed on Jan. 10, 2020, in the Japan Patent Office, the entire disclosure of each of which is hereby incorporated by reference herein.

BACKGROUND

Technical Field

This disclosure relates to a sheet conveying device and an image forming apparatus incorporating the sheet conveying device.

Discussion of the Background Art

Various types of sheet conveying devices includes a first duct, a second duct, and a switching member. The first duct is disposed facing the first face of a sheet in a sheet conveyance passage and has a first air blowing port through which air is blown toward the sheet conveyance passage. The second duct is disposed facing the second face of the sheet in the sheet conveyance passage and has a second air blowing port through which air is blown toward the sheet conveyance passage. The switching member is disposed downstream from the first duct and the second duct in a sheet conveyance direction to switch the sheet conveyance passage for the sheet to pass through.

SUMMARY

At least one aspect of this disclosure provides a sheet conveying device including a first duct, a second duct, and a switching member. The first duct is disposed at a first side of a sheet conveyance passage to face a first face of a sheet passing the sheet conveyance passage. The first duct has a first air blowing port through which air is blown toward the sheet conveyance passage. The second duct is disposed at a second side of the sheet conveyance passage to face a second face, opposite the first face, of the sheet passing the sheet conveyance passage. The second duct has a second air blowing port through which air is blown toward the sheet conveyance passage. The switching member is disposed downstream from the first air blowing port and the second air blowing port in a sheet conveyance direction and configured to switch the sheet conveyance passage. No pair of rollers is disposed between the switching member and each of the first air blowing port and the second air blowing port.

Further, at least one aspect of this disclosure provides an image forming apparatus including an image forming device configured to form an image on a sheet, and the above-described sheet conveying device configured to convey the sheet from the image forming device.

Further, at least one aspect of this disclosure provides a sheet conveying device including a sheet conveying device including a first duct, a second duct, and a switching member. The first duct is disposed at a first side of a sheet conveyance passage to face a first face of a sheet passing the sheet conveyance passage. The first duct has a first air blowing port through which air is blown toward the sheet conveyance passage. The second duct is disposed at a second side of the sheet conveyance passage to face a second face, opposite the first face, of the sheet passing the sheet conveyance passage. The second duct has a second air blowing port through which air is blown toward the sheet conveyance passage. The switching member is disposed downstream from the first air blowing port and the second air blowing port in a sheet conveyance direction and configured to switch the sheet conveyance passage and a course of each of air blown out from the first air blowing port and air blown out from the second air blowing port.

Further, at least one aspect of this disclosure provides an image forming apparatus including an image forming device configured to form an image on a sheet, and the above-described sheet conveying device configured to convey the sheet from the image forming device.

BRIEF DESCRIPTION OF THE SEVERAL VIEWS OF THE DRAWINGS

An exemplary embodiment of this disclosure will be described in detail based on the following figured, wherein.

Figure 1:
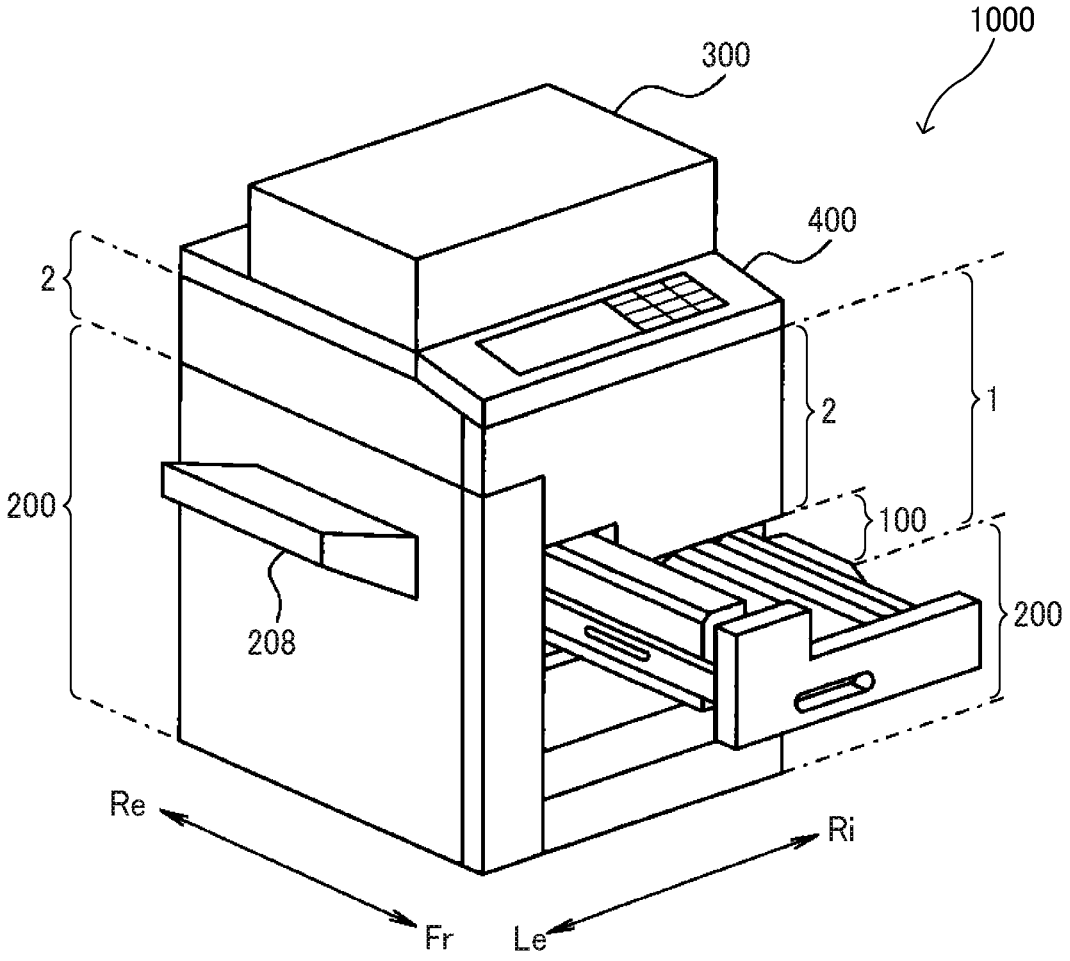
FIG. 1 is an external perspective view illustrating an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a detailed description is given of an embodiment of this disclosure with reference to the drawings.

First, a description is given of an image forming apparatus according to the embodiment.

FIG. 1 is an external perspective view illustrating an image forming apparatus 1000 according to an embodiment of this disclosure.

The image forming apparatus 1000 includes a printing device 1, a sheet feeding and ejecting device 200, a scanner 300, and a control panel 400. The printing device 1 forms and prints an image by an electrophotographic method. An automatic document feeder is mounted on the scanner 300.

The printing device 1 that forms an image on a sheet includes an image forming device 2 and a sheet conveying device 100. As illustrated in FIG. 1, the sheet conveying device 100 is slidably movable relative to a housing of the printing device 1 that includes the image forming device 2, so that the sheet conveying device 100 is removable from the housing of the printing device 1.

In FIG. 1, the image forming apparatus 1000 is illustrated from a diagonally left front side. An arrow Fr direction in FIG. 1 indicates a direction toward a front side of the image forming apparatus 1000 in the interior of the image forming apparatus 1000. A direction indicated by arrow Re indicates a direction toward a rear side of the image forming apparatus 1000 in the interior of the image forming apparatus 1000. A direction indicated by arrow Ri indicates a direction toward a right side of the image forming apparatus 1000 in the interior of the image forming apparatus 1000. A direction indicated by arrow Le indicates a direction toward a left side of the image forming apparatus 1000 in the interior of the image forming apparatus 1000.

Figure 2:
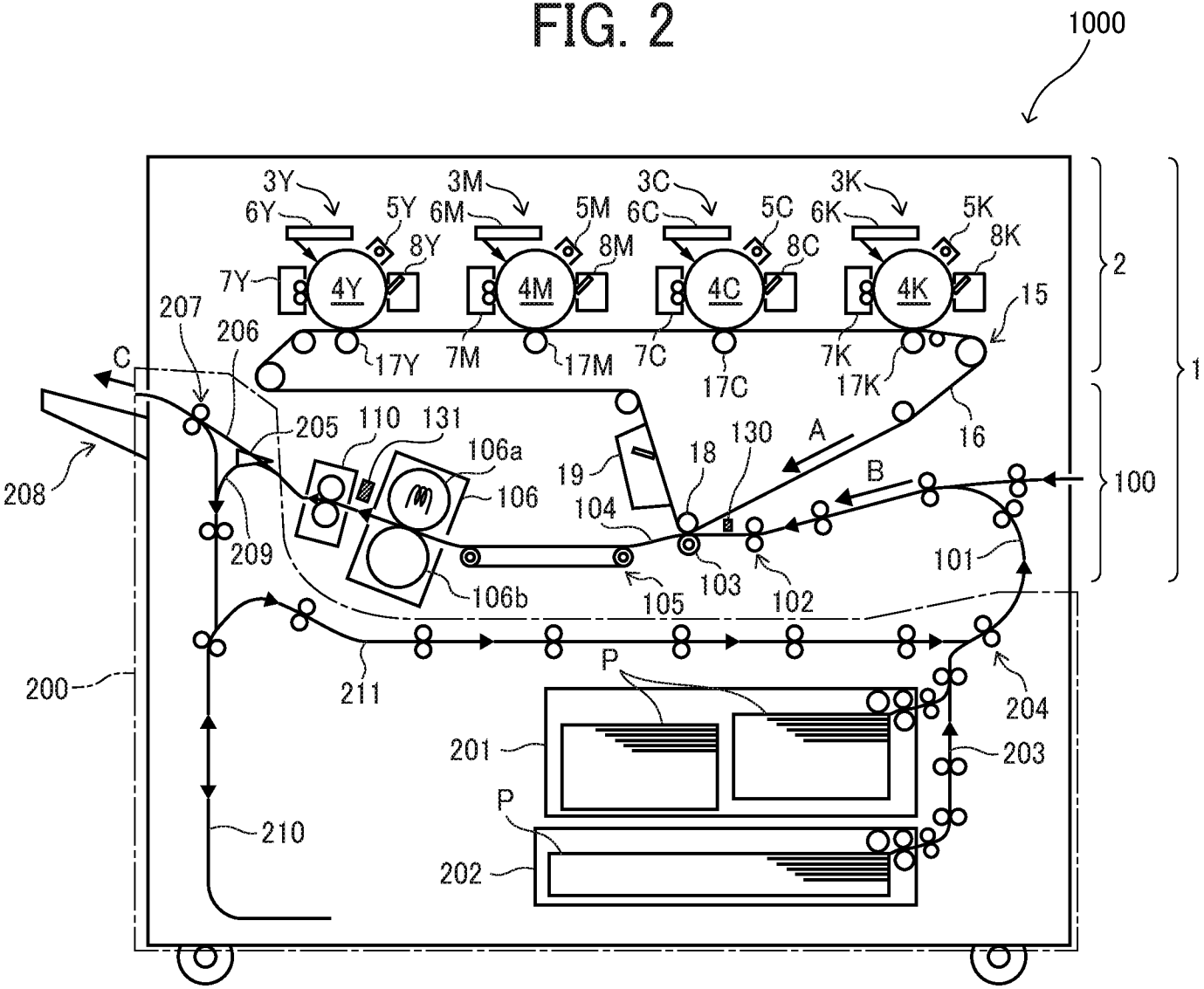
FIG. 2 is a diagram illustrating an outline of internal structures of a printing device and a sheet feeding and ejecting device of the image forming apparatus of FIG. 1, viewed from a front side of the image forming apparatus.

FIG. 2 is a diagram illustrating an outline of internal structures of the printing device 1 and the sheet feeding and ejecting device 200 of the image forming apparatus 1000 of FIG. 1, viewed from the front side of the image forming apparatus 1000.

The image forming device 2 of the printing device 1 includes image forming units 3Y, 3M, 3C, and 3K to form toner images of yellow (Y), magenta (M), cyan (C), and black (K), respectively. The image forming units 3Y, 3M, 3C, and 3K are arranged at a given pitch in a lateral direction of the image forming apparatus 1000. Note that suffixes Y, M, C, and K after respective numerals indicate members or devices for forming yellow, magenta, cyan, and black toner images, respectively.

The image forming device 2 further includes a sheet transfer unit 15 disposed below the image forming units 3Y, 3M, 3C, and 3K for forming yellow, magenta, cyan, and black toner images, respectively.

The image forming units 3Y, 3M, 3C, and 3K for forming yellow, magenta, cyan, and black toner images have substantially identical configurations to each other, except that the colors of toners to be used for forming respective color toner images are different from each other. Hereinafter, the configuration of each image forming unit (i.e., the image forming units 3Y, 3M, 3C, and 3K) is described without the suffixes and the image forming unit is referred to in a singular form, for example, as the "image forming unit 3." In addition, the following devices and units provided in each image forming unit 3 are also referred to in a singular form occasionally.

The image forming unit 3 (i.e., the image forming units 3Y, 3M, 3C, and 3K) includes a drum-shaped photoconductor 4 (i.e., photoconductors 4Y, 4M, 4C, and 4K). Furthermore, the image forming unit 3 includes an electric charger 5 (i.e., electric chargers 5Y, 5M, 5C, and 5K), an exposure device 6 (i.e., exposure devices 6Y, 6M, 6C, and 6K), a developing device 7 (i.e., developing devices 7Y, 7M, 7C, and 7K), and a drum cleaning device 8 (i.e., drum cleaning devices 8Y, 8M, 8C, and 8K). The electric charger 5, the exposure device 6, the developing device 7, and the drum cleaning device 8 are disposed around the photoconductor 4.

In the image forming unit 3, the photoconductor 4 is rotationally driven in a counterclockwise direction in FIG. 2, and a circumferential surface of the photoconductor 4 is uniformly charged by the electric charger 5 at a position facing the electric charger 5. According to this configuration, the circumferential surface of the photoconductor 4 is charged to the same polarity as a charging polarity of the toner. After the surface of the photoconductor 4 is uniformly charged, the surface of the photoconductor 4 is optically scanned by the exposure device 6 that emits laser light modulated based on image data. The irradiated area of the surface of the photoconductor 4 exposed by the optical scanning has potential attenuated to carry (bear) an electrostatic latent image.

A corresponding toner of the yellow, magenta, cyan, and black toners is made to selectively adhere by the developing device 7 to develop the electrostatic latent image into a visible toner image. With rotation of the photoconductor 4, the toner image enters a primary transfer nip region at which the toner image is transferred. The primary transfer nip region is formed by contact between the photoconductor 4 and an intermediate transfer belt 16. The details of the intermediate transfer belt 16 is described below.

The sheet transfer unit 15 causes the intermediate transfer belt 16 to move endlessly in a direction indicated by arrow A in FIG. 2 by rotating one of a plurality of rollers while the intermediate transfer belt 16 is wound and stretched around the plurality of rollers disposed inside a loop of the intermediate transfer belt 16.

Among the plurality of rollers disposed inside the loop of the intermediate transfer belt 16, a primary transfer roller 17 (i.e., primary transfer rollers 17Y, 17M, 17C, and 17K) for transferring the toner image interposes the intermediate transfer belt 16 in a space with the photoconductor 4 that carries (bears) the toner image. With this configuration, the primary transfer nip region is formed by the contact between the photoconductor 4 and an outer circumferential surface of the intermediate transfer belt 16.

The primary transfer roller 17 is applied with primary transfer bias having a polarity opposite to the charging polarity of the toner. With this configuration, a primary transfer electric field is formed at the primary transfer nip region, and the primary transfer electric field electrostatically moves (transfers) the toner image formed on the photoconductor 4, from the surface of the photoconductor 4 onto the surface of the intermediate transfer belt 16. The toner image on the photoconductor 4 is primarily transferred onto the outer circumferential surface of the intermediate transfer belt 16 by an action of the primary transfer electric field and an action of a nip pressure at the primary transfer nip region.

After the photoconductor 4 has passed through the primary transfer nip region, transfer residual toner that has not been primarily transferred onto the intermediate transfer belt 16 remains on the surface of the photoconductor 4. The transfer residual toner is removed from the surface of the photoconductor 4 by the drum cleaning device 8.

The above-described electrophotographic processes are performed with each of the image forming units 3Y, 3M, 3C, and 3K for forming respective yellow, magenta, cyan, and black toner images on the surfaces of the photoconductors 4Y, 4M, 4C, and 4K.

To be more specific, the primary transfer rollers 17Y, 17M, 17C, and 17K are aligned inside the loop of the intermediate transfer belt 16 and interpose the intermediate transfer belt 16 in each space with the photoconductors 4Y, 4M, 4C, and 4K, respectively. With this configuration, the primary transfer nip regions for transferring the yellow, magenta, cyan, and black toner images are formed by contact between the outer circumferential surface of the intermediate transfer belt 16 and the photoconductors 4Y, 4M, 4C, and 4K.

According to the order of alignment of the photoconductors 4Y, 4M, 4C, and 4K, the yellow toner is first transferred onto the outer circumferential surface of the intermediate transfer belt 16 in the process of primary transfer. Then, the magenta, cyan, and black toner images are transferred at the respective primary transfer nip regions in a manner sequentially superimposed on the yellow toner image that has been primarily transferred onto the outer circumferential surface of the intermediate transfer belt 16. With this structure, a four-color composite toner image is formed on the outer circumferential surface of the intermediate transfer belt 16.

A secondary transfer roller 103 is disposed below the intermediate transfer belt 16. The secondary transfer roller 103 interposes the intermediate transfer belt 16 in a space with a secondary transfer opposing roller 18 disposed inside the loop of the intermediate transfer belt 16. With this configuration, a secondary transfer nip region is formed by contact of the outer circumferential surface of the intermediate transfer belt 16 and the secondary transfer roller 103. In the secondary transfer nip region, a secondary electric field is formed between the secondary transfer opposing roller 18 and the secondary transfer roller 103. The secondary transfer opposing roller 18 is applied with secondary transfer bias having the same polarity as the charging polarity of the toner. The secondary transfer roller 103 is electrically grounded.

The four-color composite toner image on the outer circumferential surface of the intermediate transfer belt 16 enters the secondary transfer nip region along with the endless movement of the intermediate transfer belt 16.

The sheet feeding and ejecting device 200 of the image forming apparatus 1000 includes a large-capacity sheet bank 201 and a sheet feed tray 202 below the sheet conveying device 100 of the printing device 1. A sheet P fed out from the sheet bank 201 or the sheet feed tray 202 into a sheet feed passage 203 is conveyed upward by a plurality of pairs of sheet conveying rollers disposed along the sheet feed passage 203 in a direction indicated by arrow B in FIG. 2. Then, the sheet P is delivered into a sheet conveyance passage 101 of the sheet conveying device 100 of the printing device 1 by a pair of sheet transfer rollers 204 provided near a terminal of the sheet feed passage 203.

The sheet P that has been transferred from the sheet feed passage 203 to the sheet conveyance passage 101 is conveyed by a plurality of pairs of sheet conveying rollers disposed along the sheet conveyance passage 101. When the sheet P contacts a registration nip region between a pair of sheet registration rollers 102 disposed near a terminal of the sheet conveyance passage 101, skew of the sheet P is corrected. Thereafter, the sheet P is conveyed to the secondary transfer nip region as the pair of sheet registration rollers 102 rotates at a timing in synchronization with movement of the four-color composite toner image on the intermediate transfer belt 16.

The four-color composite toner image is secondarily transferred by an action of the secondary transfer electric field and an action of the nip pressure onto the sheet P that is brought to closely contact with the four-color composite toner image on the intermediate transfer belt 16 at the secondary transfer nip region. Consequently, a full-color image is formed on the sheet P of white color.

After the intermediate transfer belt 16 has passed through the secondary transfer nip region, transfer residual toner that has not been secondarily transferred onto the sheet P remains on the outer circumferential surface of the intermediate transfer belt 16. The transfer residual toner is removed from the intermediate transfer belt 16 by a belt cleaning device 19.

The sheet conveying device 100 of the printing device 1 further includes a post-transfer conveyance passage 104, a sheet conveyance belt unit 105, a fixing device 106, and a conveyance cooling unit 110, in addition to the sheet conveyance passage 101, the pair of sheet registration rollers 102, and the secondary transfer roller 103.

The sheet P that has passed through the secondary transfer nip region is conveyed to the post-transfer conveyance passage 104. The post-transfer conveyance passage 104 runs through the sheet conveyance belt unit 105, the fixing device 106, and the conveyance cooling unit 110.

The sheet P conveyed to the post-transfer conveyance passage 104 is first conveyed from the right side to the left side of the image forming apparatus 1000 by the sheet conveyance belt unit 105, and then conveyed into the fixing device 106.

The fixing device 106 forms a fixing nip region by contact between a fixing roller 106*a* and a pressure roller 106*b* pressed against the fixing roller 106*a*. The fixing roller 106*a* includes a heat source such as a halogen lamp. The sheet P conveyed into the fixing device 106 enters the fixing nip region in which heat and pressure are applied to the sheet P. Consequently, a full-color image is fixed to the surface of the sheet P.

The sheet P that has passed through the fixing device 106 passes through the conveyance cooling unit 110, and then is conveyed to a left end of the sheet feeding and ejecting device 200.

The left end of the sheet feeding and ejecting device 200 is provided with a switching claw 205, a sheet ejection passage 206, a pair of sheet ejection rollers 207, a sheet reverse passage 209, and a switchback passage 210. Additionally, a sheet reentry passage 211 is disposed above the sheet bank 201 in the sheet feeding and ejecting device 200.

The switching claw 205 that functions as a switching member moves to switch and select a subsequent conveyance destination of the sheet P that has been delivered to the left end of the sheet feeding and ejecting device 200 from the conveyance cooling unit 110 of the sheet conveying device 100 of the printing device 1. The sheet ejection passage 206 that functions as a second branch conveyance passage is selected as the conveyance destination of the sheet P at completion of single-sided printing in a single-side printing mode to form an image on one side of the sheet P or completion of double-sided printing in a duplex printing mode to form an image on both faces of the sheet P. The sheet P that has been conveyed to the sheet ejection passage 206 passes through the pair of sheet ejection rollers 207, and then is ejected to the outside of the image forming apparatus 1000 in a direction indicated by arrow C in FIG. 2, to be stacked on a sheet stacker 208.

On the other hand, when the single-sided printing in the duplex printing mode is finished, in other words, an image is formed on one side or a first side of the sheet P, the sheet reverse passage 209 that functions as a first branch conveyance passage is selected as the conveyance destination of the sheet P. The sheet P that has been conveyed to the sheet reverse passage 209 enters the switchback passage 210, and then is turned upside down by a switchback operation to be conveyed to the sheet reentry passage 211. Then, the sheet P passes through the sheet reentry passage 211, and then is conveyed again to the sheet conveyance passage 101. Thereafter, a full-color image is secondarily transferred onto the other side or a second side of the sheet P at the secondary transfer nip region. Then, the sheet P sequentially passes through the fixing device 106, the conveyance cooling unit 110, the sheet ejection passage 206, and the pair of sheet ejection rollers 207, and is eventually ejected to the outside of the image forming apparatus 1000.

When the sheet P is ejected onto the sheet stacker 208 with face down, the sheet reverse passage 209 is selected as the conveyance destination of the sheet P. The sheet P that has been conveyed to the sheet reverse passage 209 enters the switchback passage 210, and then is turned upside down by a switchback operation to be ejected to the outside of the image forming apparatus 1000.

The image forming apparatus 1000 further includes a registration roller exit sensor 130 and a fixing device exit sensor 131. The registration roller exit sensor 130 detects the sheet P after the sheet P has passed through the pair of sheet registration rollers 102. The fixing device exit sensor 131 detects the sheet P after the sheet P has passed through the fixing device 106.

The sheet P that has passed through the fixing device 106 is high in temperature. In recent years, a printing speed is remarkably accelerated, and in a case in which the sheet P is conveyed while having high temperature, the face of a sheet P with an image is likely to be streaked or scratched due to a load of a guide member or a blocking phenomenon in which sheets P stick to each other is likely to occur.

The conveyance cooling unit 110 cools a sheet P while conveying the sheet P conveyed from the fixing device 106.

Figure 3:
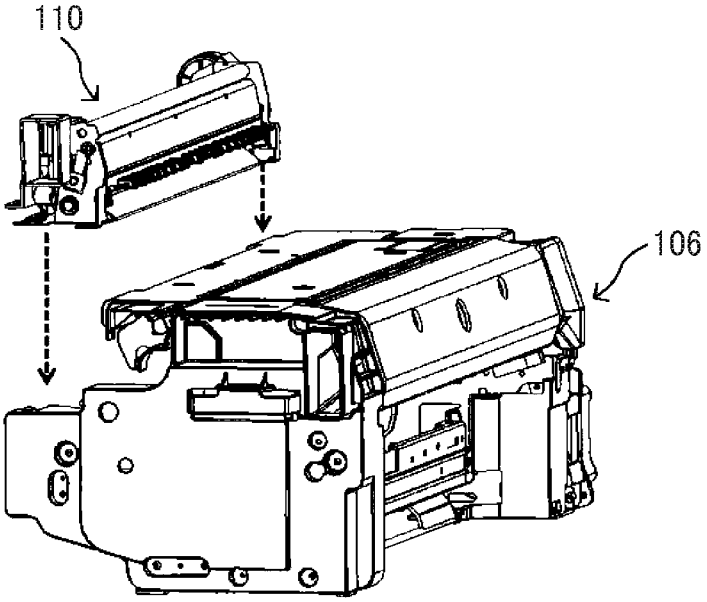
FIG. 3 is a perspective view illustrating a fixing device and a conveyance cooling unit.

FIG. 3 is a perspective view illustrating the fixing device 106 and the conveyance cooling unit 110.

As indicated by an arrow in FIG. 3, the conveyance cooling unit 110 is installed in the fixing device 106 so that a sheet P is cooled while the conveyance cooling unit 110 is conveying the sheet P immediately after the sheet P is ejected from the fixing device 106.

Figure 4:
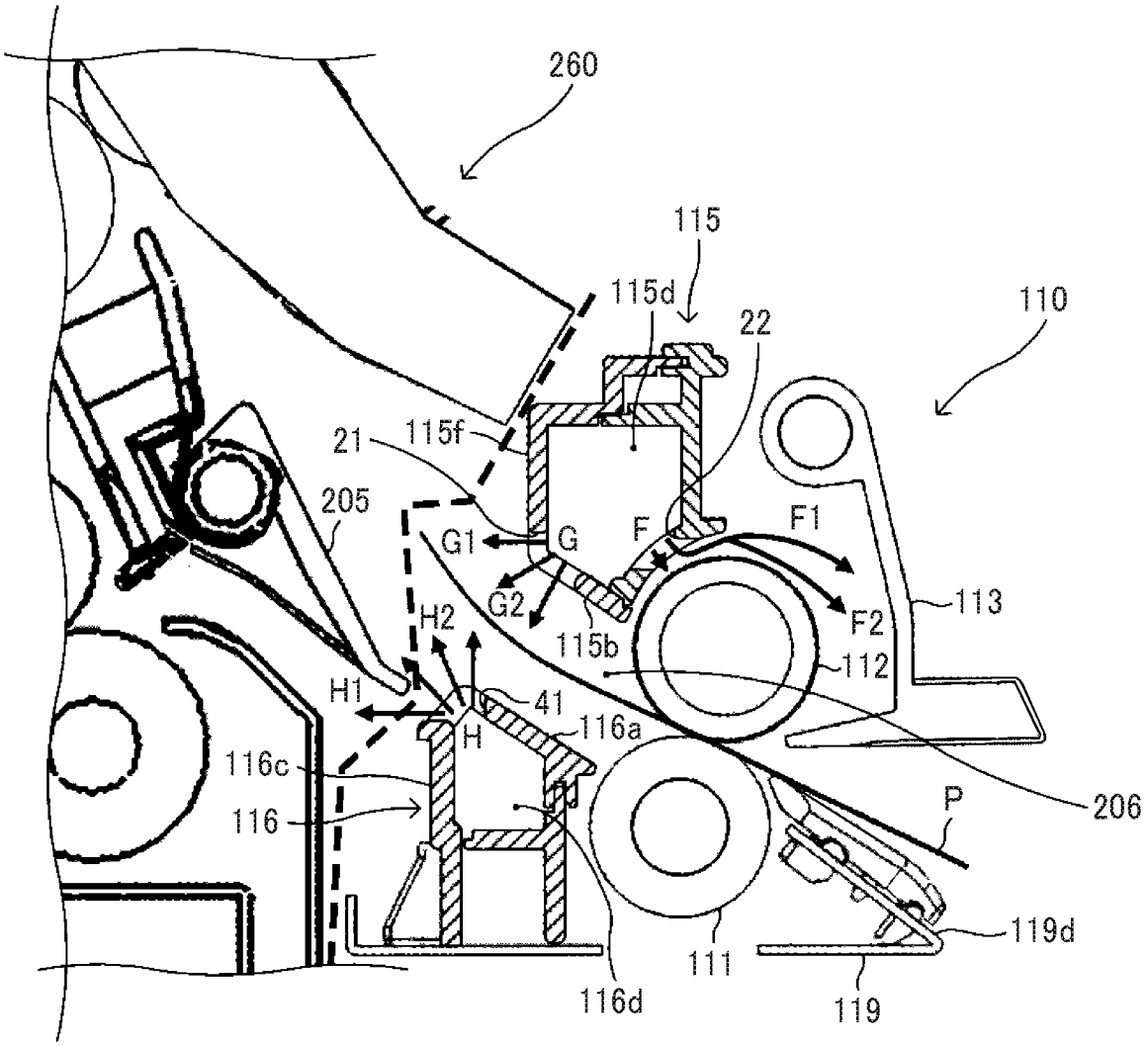
FIG. 4 is a transverse cross-sectional view illustrating the conveyance cooling unit together with a sheet being conveyed.

FIG. 4 is a transverse cross-sectional view illustrating the conveyance cooling unit 110 together with the sheet P being conveyed.

The conveyance cooling unit 110 forms a conveyance nip region by contact of a drive roller 111 that performs rotational drive and a driven roller 112 pressed against the drive roller 111, so that the conveyance cooling unit 110 applies conveyance force to the sheet P sandwiched by the drive roller 111 and the driven roller 112 at the conveyance nip region.

The conveyance cooling unit 110 further includes an upper nip guide member 113, a lower nip guide member 119*d*, an upper air duct 115, and a lower air duct 116. The lower nip guide member 119*d* is mounted on a sheet metal frame 119. The sheet P that is conveyed immediately after the fixing device 106 and before reaching the conveyance cooling unit 110 is conveyed through between the upper nip guide member 113 and the lower nip guide member 119*d* to be guided toward the conveyance nip region.

The upper air duct 115 that functions as a first duct includes a plurality of upper conveyance passage blowout ports 21 and a plurality of roller blowout ports 22. The plurality of upper conveyance passage blowout ports 21 that functions as a first air blowing port is provided at given intervals in a sheet width direction (also referred to as an axial direction of the driven roller 112 and a duct longitudinal direction). The plurality of upper conveyance passage blowout ports 21 blows out air toward the sheet ejection passage 206 that is a sheet conveyance passage. The plurality of roller blowout ports 22 is also provided at given intervals in the sheet width direction (i.e., the axial direction of the driven roller 112 and the duct longitudinal direction). The plurality of roller blowout ports 22 faces the driven roller 112 that functions as a sheet conveying roller to blow out the air toward the driven roller 112.

Additionally, the lower air duct 116 that functions as a second duct includes a plurality of lower conveyance passage blowout ports 41 that functions as a second air blowout port to blow out the air toward the sheet ejection passage 206.

As indicated by arrow G in FIG. 4, the cooling air that has been conveyed to an upper air blowing passage 115*d* of the upper air duct 115 is blown from the plurality of upper conveyance passage blowout ports 21 onto an upper face of the sheet P that has passed through the conveyance nip region. Additionally, as indicated by arrow H in FIG. 4, the cooling air that has been conveyed to a lower air blowing passage 116*d* of the lower air duct 116 is blown from the lower conveyance passage blowout ports 41 onto a lower face of the sheet P that has passed through the conveyance nip region. Consequently, the sheet P heated at the fixing device 106 is cooled from both the upper face side and the lower face side of the sheet P.

The sheet P to which the image has been fixed by the fixing device 106 is conveyed to the conveyance nip region between the driven roller 112 and the drive roller 111 while the sheet P keeps a high temperature. In the conveyance nip region, the heat of the sheet P is transmitted to the driven roller 112 and the drive roller 111, and both the temperature of the driven roller 112 and the temperature of the drive roller 111 rise. In a case in which sheets P are continuously brought to pass the conveyance nip region, heat is exchanged from the sheets P to the pair of the rollers, which are the drive roller 111 and the driven roller 112, because the drive roller 111 and the driven roller 112 have the temperatures lower than the temperatures of the sheets P in an initial stage. However, the heat exchange is not performed on a sheet P being sandwiched (nipped) between the drive roller 111 and the driven roller 112 having the temperatures that have gradually risen, and therefore the sheet P is conveyed downstream in the sheet conveyance direction while the sheet P remains at the high temperature. As a result, it is likely that the sheet temperature does not go down (lower) to a target temperature by the cooling by blowing the air from the upper air duct 115 and the air from the lower air duct 116, which may cause the blocking phenomenon in which sheets P stick to each other.

For example, a known sheet conveying device includes multiple ducts and a cooling device. One duct of the multiple ducts is disposed on a side to face the first face of the sheet conveyed from a fixing device. Another duct of the multiple ducts is disposed on a side to face the second face, that is, the opposite side of the sheet. The cooling device blows air to both sides of the sheet conveyed in the sheet conveyance passage to cool the sheet. A switching member is disposed downstream from the cooling device in the sheet conveyance direction, to switch the sheet conveyance passage between a sheet ejection passage in which a sheet is conveyed to the outside of the known sheet conveying device and a sheet reverse passage in which the sheet is reversed and conveyed again to an image forming device.

However, even after the cooling device substantially removes heat of the sheet, residual heat remaining in the sheet may increase the temperatures of other members (such as a guide to guide the sheet and a conveyance roller to convey the sheet) disposed downstream from the cooling device in the sheet conveyance direction.

Also, in FIG. 4, in the case in which the sheets P are continuously brought to pass the conveyance nip region, it is likely that the surface temperature of the driven roller 112 or the surface temperature of the drive roller 111 rise close to a toner melting point. In a case in which the surface temperature of the driven roller 112 or the surface temperature of the drive roller 111 rises to the temperature close to the toner melting point, the toner on the sheet P may fixedly adhere to the surface of the drive roller 111 or the surface of the driven roller 112. Thus, when the toner fixedly adheres to the surface of the drive roller 111 or the surface of the driven roller 112, the conveyed sheet P tends to stick to the drive roller 111 or the driven roller 112, and the sheet P may be wound around the drive roller 111 or the driven roller 112 along an outer diameter of the drive roller 111 or the driven roller 112. Consequently, conveyance failure may occur, thereby causing paper jam inside the fixing device 106. Particularly, the driven roller 112 contacts the sheet P on the side where the sheet P contacts the fixing roller 106*a* to heat the sheet P. Therefore, the temperature of the driven roller 112 easily rises higher than the temperature of the drive roller 111. Furthermore, since the toner image immediately after the fixing process contacts the driven roller 112, toner adhesion is likely to occur.

However, in the present embodiment, as indicated by arrow F in FIG. 4, the cooling air is directly conveyed from the roller blowout ports 22 provided on the upper air duct 115 and facing the driven roller 112, toward the driven roller 112 at a distance close to the driven roller 112. Consequently, the configuration is effective to constantly cool the driven roller 112. As a result, when the temperature of the driven roller 112 rises due to the sheet passage, the driven roller 112 is simultaneously cooled to restrain an increase in temperature of the driven roller 112. Consequently, the toner is restrained from adhering to the driven roller 112, and the conveyed sheet is prevented from being wound around the driven roller 112.

Additionally, while the sheet P is not conveyed, the heat of the drive roller 111 is transmitted to the driven roller 112, and therefore the temperature of the drive roller 111 is restrained from rising. Furthermore, when the heat of the drive roller 111 is transmitted the driven roller 112 to increase the temperature of the driven roller 112, the driven roller 112 is cooled simultaneously. Consequently, the temperature of the drive roller 111 is restrained from rising, and toner adhesion onto the surface of the drive roller 111 is prevented. Accordingly, the conveyed sheet is prevented from being wound around the driven roller 112.

Furthermore, since the temperature of the driven roller 112 and the temperature of the drive roller 111 are restrained from rising, heat exchange is excellently performed on the sheet P in the conveyance nip region to lower the temperature of the sheet P. Consequently, the cooling by blowing the air from the upper air duct 115 and the lower air duct 116 excellently lowers the sheet temperature to the target temperature and further restrains occurrence of the blocking phenomenon in which the sheets P stick to each other.

The driven roller 112 may include a metal roller. In a case in which a material of the driven roller 112 is metal, the roller temperature tends to be higher because thermal conductivity of the metal is higher than thermal conductivity of a rubber member. Therefore, with this configuration of the present embodiment in which the driven roller 112 is directly cooled by the air, the temperature of the driven roller 112 is effectively restrained, the heat exchange with the sheet P is enhanced, and the sheet P is excellently cooled in the conveyance nip region.

The driven roller 112 may also be a member obtained by casing a surface of the driven roller 112 with a material such as a hollow film material to which the toner hardly adheres. Furthermore, the surface of the driven roller 112 is preferably made conductive. The driven roller 112 having a conductive surface is efficacious to restrain electrical charge of the driven roller 112.

Moreover, the driven roller 112 may have a member obtained by covering an outer shape of a cored bar with a rubber member such as silicon, and by further casing the covered cored bar with a material such as perfluoroalkoxy alkane (PFA) to which the toner hardly adheres. At this time, it is preferable to adopt a method in which the rubber member is made conductive so as to ground static electricity to the earth when the static electricity is generated at the time of sheet passage. Consequently, the driven roller 112 is prevented from being electrically charged. The casing with the PFA is omitted when the rubber member is made to contain a material such as polytetrafluoroethylene (PTFE) to which the toner hardly adheres, or the surface of the driven roller 112 is coated with such a material.

Additionally, in the present embodiment, even when the sheet P is not present in the conveyance cooling unit 110, the cooling air is continuously blown out from the plurality of upper conveyance passage blowout ports 21, the plurality of roller blowout ports 22, and the plurality of lower conveyance passage blowout ports 41. Consequently, the temperature of the driven roller 112 is excellently restrained from rising. Furthermore, even when the sheet P is not present in the conveyance cooling unit 110, the cooling air is continuously blown out from the plurality of upper conveyance passage blowout ports 21 and the plurality of lower conveyance passage blowout ports 41. Therefore, the air blown out from the plurality of upper conveyance passage blowout ports 21 flows to the sheet ejection passage 206 and the sheet reverse passage 209 of a sheet ejection unit 260 located on a left side from a broken line in FIG. 4 and cools guides and pairs of sheet conveying rollers provided to the sheet ejection passage 206 and the sheet reverse passage 209 of the sheet ejection unit 260.

The plurality of upper conveyance passage blowout ports 21 is provided on a downstream side in a sheet conveyance direction (hereinafter, also simply referred to as a conveyance direction) of an upper sheet guide face 115*b* of the upper air duct 115 facing the upper face of the sheet P conveyed to the sheet ejection passage 206. The plurality of upper conveyance passage blowout ports 21 extends to a downstream end of the plurality of upper conveyance passage blowout ports 21, and further extends to a lower side of a downstream side wall 115*f* located on the downstream side of the upper air duct 115 in the sheet conveyance direction. With this configuration, a downstream end in the conveyance direction of each of the plurality of upper conveyance passage blowout ports 21 is located at a position more retreated from the sheet ejection passage 206, than the upper sheet guide face 115*b* is. As a result, the leading end of a sheet P is prevented from being caught at the downstream end in the conveyance direction of any of the plurality of upper conveyance passage blowout ports 21, and occurrence of sheet edge folding error or occurrence of conveyance failure is prevented.

Furthermore, since the plurality of upper conveyance passage blowout ports 21 extends to the lower side of the downstream side wall 115*f*, the cooling air is blown out toward the sheet ejection unit 260 located more on the left side than the broken line in FIG. 4 (arrow G1 in FIG. 4) as well as toward the lower air duct 116 (arrow G2 in FIG. 4). Consequently, the cooling air is blown onto a broad range of the upper face of the sheet P, and the temperature of the sheet P is excellently decreased.

Additionally, since the cooling air is blown toward the sheet ejection passage 206 and the sheet reverse passage 209 of the sheet ejection unit 260 (arrow G1 in FIG. 4), the cooling air is brought to excellently flow toward the guides and the pairs of sheet conveying rollers provided in the sheet ejection passage 206 and the sheet reverse passage 209 of the sheet ejection unit 260, and therefore the temperature of the sheet ejection unit 260 is restricted from rising.

Furthermore, similar to the plurality of upper conveyance passage blowout ports 21, the plurality of lower conveyance passage blowout ports 41 are provided on the downstream side in the conveyance direction of a lower sheet guide face 116*a* of the lower air duct 116 facing the lower face of the sheet P conveyed in the sheet ejection passage 206. The plurality of lower conveyance passage blowout ports 41 extends to a downstream end in the conveyance direction and further extends to an upper side of a downstream side wall 116*c* of the lower air duct 116. With this configuration, a downstream end of the plurality of lower conveyance passage blowout ports 41 is located at respective positions more retracted from the sheet ejection passage 206, than the lower sheet guide face 116*a* is. Therefore, the leading end of the sheet P is prevented from being caught at the downstream end in the conveyance direction of the plurality of lower conveyance passage blowout ports 41, and occurrence of sheet edge folding error or occurrence of conveyance failure is prevented.

Additionally, since the plurality of lower conveyance passage blowout ports 41 extends to the upper side of the downstream side wall 116*c*, the cooling air is blown out toward the sheet ejection passage 206 and the sheet reverse passage 209 of the sheet ejection unit 260 located more on the left side than the broken line in FIG. 4 (arrow H1 in FIG. 4) as well as toward the sheet ejection passage 206 (arrow H2 in FIG. 4). Consequently, a part of the cooling air blown out from the plurality of lower conveyance passage blowout ports 41 is brought to flow to the sheet ejection passage 206 and the sheet reverse passage 209 of the sheet ejection unit 260, and the guides and the pairs of sheet conveying rollers provided in the sheet ejection passage 206 and the sheet reverse passage 209 of the sheet ejection unit 260 are excellently cooled.

Furthermore, in the present embodiment, among the cooling air blown out from the plurality of roller blowout ports 22, the cooling air, which flows along the surface of the driven roller 112 and is directed to the upstream side in the conveyance direction as indicated by arrows F1 and F2 in FIG. 4, is blocked by the upper nip guide member 113. Consequently, the cooling air blown out from the plurality of roller blowout ports 22 is restrained from flowing to the fixing device 106, and therefore the temperature of the fixing device 106 (i.e., the fixing roller 106*a*) is restrained from falling (dropping). Accordingly, occurrence of fixing failure is prevented.

Next, a detailed description is given of a configuration of the conveyance cooling unit 110 according to the present embodiment of this disclosure.

Figure 5:
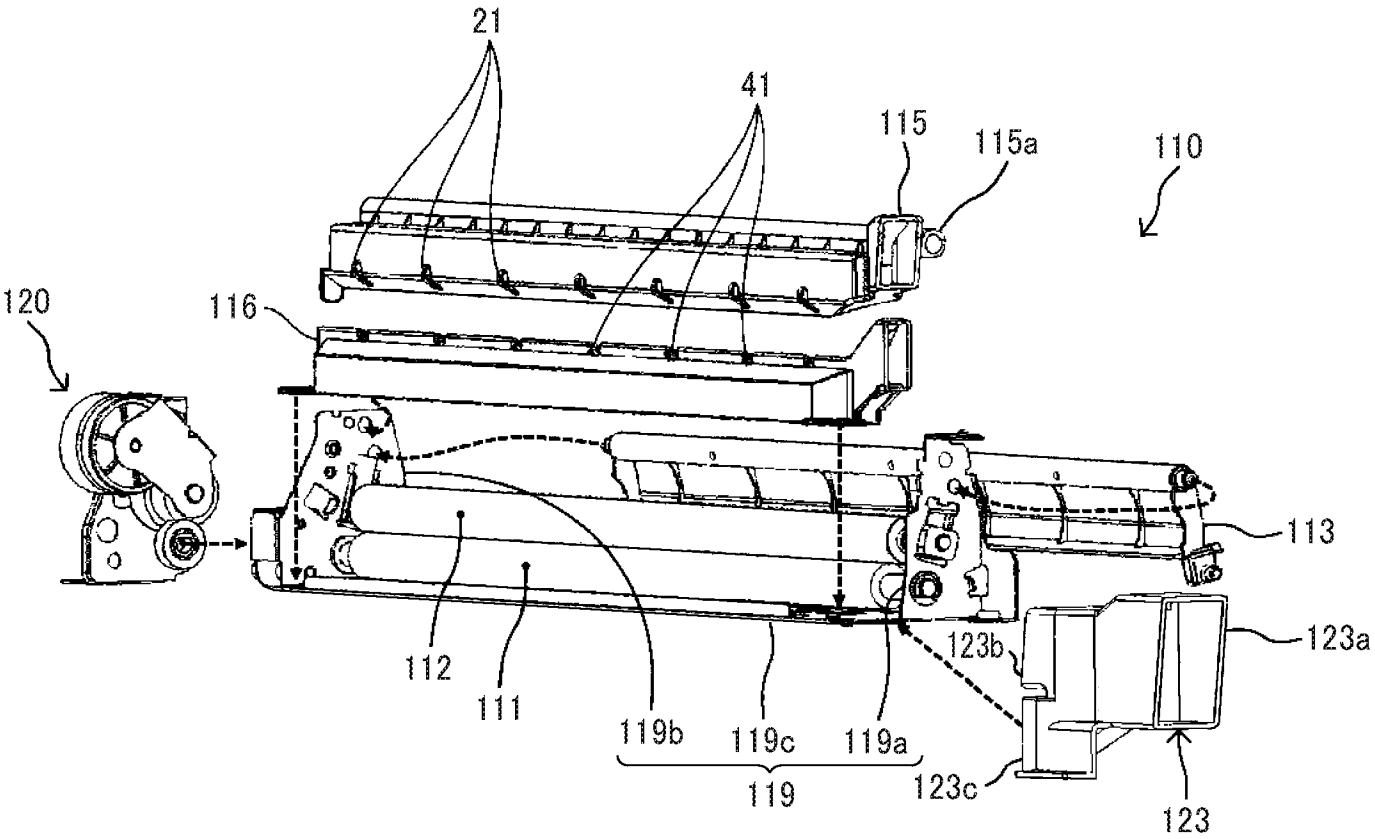
FIG. 5 is an exploded perspective view illustrating the conveyance cooling unit.

FIG. 5 is an exploded perspective view illustrating the conveyance cooling unit 110. The sheet metal frame 119 of the conveyance cooling unit 110 includes a front plate 119*a*, a rear plate 119*b*, and a bottom plate 119*c*. Note that the above-described lower nip guide member (i.e., the lower nip guide member 119*d* in FIG. 4) is also integrally formed with the sheet metal frame 119 as a single unit.

The lower air duct 116 is fixed to an upper surface of the bottom plate 119*c* of the sheet metal frame 119. The upper air duct 115 is rotatably supported by the front plate 119*a* and the rear plate 119*b* in a state in which a front support shaft and a rear support shaft are inserted into through holes of supports 115*a* provided at each end in the duct longitudinal direction. The plurality of upper conveyance passage blowout ports 21 is provided at the given intervals in the duct longitudinal direction (that is also the axial direction of the driven roller 112, the sheet width direction, and the front-rear direction of the image forming apparatus 1000). Similarly, the plurality of lower conveyance passage blow-out ports 41 is also provided at given intervals in the duct longitudinal direction.

The drive roller 111 and the driven roller 112 are rotatably supported by bearings provided on the front plate 119*a* and bearings provided on the rear plate 119*b*. A drive transmission mechanism 120 to transmit drive force to the drive roller 111 is fixed to a back face of the rear plate 119*b* of the sheet metal frame 119. Additionally, a communication pipe 123 is fixed to an end on the downstream side in the conveyance direction of the front plate 119*a* of the sheet metal frame 119.

The communication pipe 123 includes a receiver 123*a*, a first communicating portion 123*b*, and a second communicating portion 123*c*. The cooling air taken in from the outside of the image forming apparatus 1000 flows into the receiver 123*a*. The first communicating portion 123*b* communicates with the upper air duct 115 and conveys the cooling air to the upper air duct 115. The second communicating portion 123*c* communicates with the lower air duct 116 and conveys the cooling air to the lower air duct 116.

Figure 6:
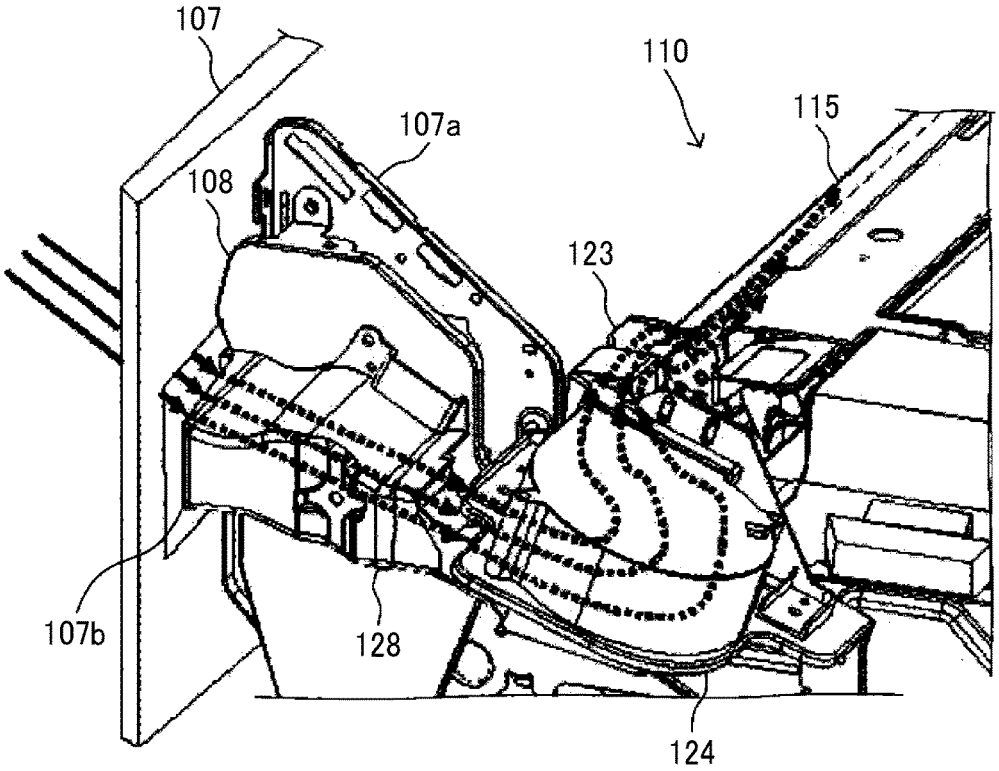
FIG. 6 is an enlarged perspective view illustrating a main part of the conveyance cooling unit.

FIG. 6 is an enlarged perspective view illustrating a main part of the conveyance cooling unit 110. Specifically, FIG. 6 illustrates a frame 107 of the sheet conveying device 100 detachable from the printing device 1 and a part of the conveyance cooling unit 110.

The frame 107 of the sheet conveying device 100 has an air suction port 107*b* for sucking outside air. The frame 107 also has a fan holding portion 107*a* projecting from the frame 107. The conveyance cooling unit 110 includes an air suction duct 128 and an air blowing fan 124. The air suction duct 128 and the air blowing fan 124 that functions as an air blower are fixed to the fan holding portion 107*a* via the holding member 108.

The air suction duct 128 has one end that is coupled to an air suction portion of the air blowing fan 124. The air suction duct 128 has an opposite end having an opening facing the air suction port 107*b* of the frame 107.

Since the air suction duct 128 is attached to the frame 107 of the sheet conveying device 100 that is detachable (removable) from the printing device 1, the air suction duct 128 follows movements, which are detachment and attachment operations, of the sheet conveying device 100, moving in the front-and-back direction of the image forming apparatus 1000.

While the printing device 1 performs a print job, the sheet conveying device 100 is inserted in the inner portion of the printing device 1. As the air blowing fan 124 rotates in this state, air suction force is generated in the air suction portion of the air blowing fan 124. Outside air is sucked into the air suction port 107*b* of the frame 107 by the air suction force this air suction force, as indicated by a broken line in FIG. 6, so that the outside air is taken inside the air blowing fan 124 via the air suction duct 128. Then, after being exhausted through the air exhausting portion of the air blowing fan 124, the outside air is blown into the upper air duct 115 and the lower air duct 116 via the communication pipe 123.

Figure 7:
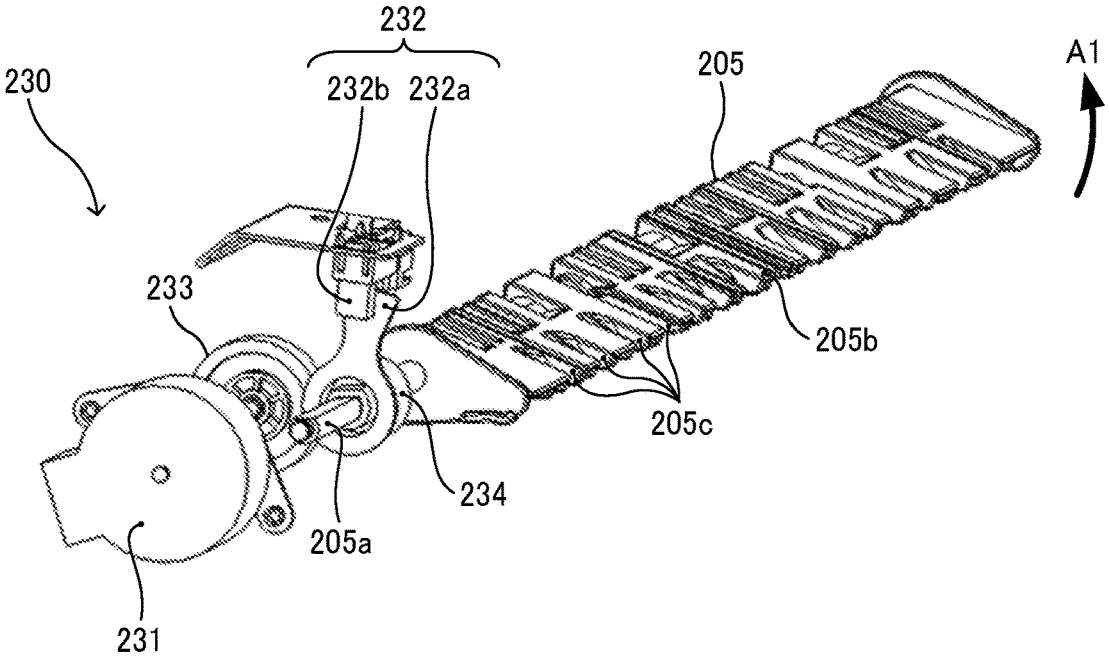
FIG. 7 is a perspective view illustrating a switching claw and a branch drive device that rotates the switching claw.

FIG. 7 is a perspective view illustrating the switching claw 205 and the switching drive device 230 that rotates the switching claw 205.

As illustrated in FIG. 7, the switching drive device 230 rotates between a sheet ejection guide position (see FIG. 8A) that functions as a second position to guide the sheet P to the sheet ejection passage 206 and a sheet reverse guide position (see FIG. 8B) that functions as a first position to guide the sheet P to the sheet reverse passage 209. In FIG. 6, the switching claw 205 is located at the sheet ejection guide position.

The switching drive device 230 includes a switching motor 231 that functions as a drive source. In the present embodiment, a stepping motor is used as the switching motor 231. A drive gear 233 is mounted on the motor shaft of the switching motor 231 and a driven gear 234 is mounted near one end of a rotary shaft 205*a* of the switching claw 205 and is meshed with the drive gear 233.

In addition, the switching drive device 230 includes a switching claw position detector 232 to detect the position of the switching claw 205. The switching claw position detector 232 includes a transmission optical sensor 232*b* and a feeler 232*a*. The transmission optical sensor 232*b* includes a light emitting element and a light receiving element. The feeler 232*a* is mounted on the driven gear 234. When the switching claw 205 is located between the sheet ejection guide position and the sheet reverse guide position, the feeler 232*a* is located at a position between the light emitting element and the light receiving element of the transmission optical sensor 232*b* to block light of the light emitting element of the transmission optical sensor 232*b*. When the switching claw 205 is located at the sheet ejection guide position or at the sheet reverse guide position, the feeler 232*a* is separated from the position between the light emitting element and the light receiving element of the transmission optical sensor 232*b*, so that the light of the light emitting element of the transmission optical sensor 232*b* is not blocked by the feeler 232*a* and is received by the light receiving element of the transmission optical sensor 232*b*. According to this configuration, the switching claw position detector 232 detects that the switching claw 205 is located at the sheet ejection guide position or at the sheet reverse guide position.

Figure 12:
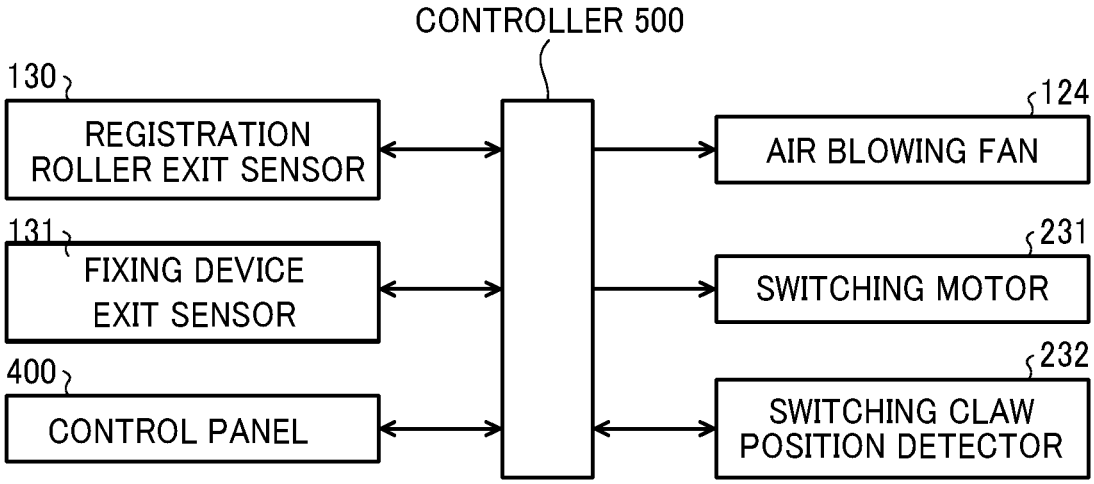
FIG. 12 is a block diagram illustrating a part of an electric circuit in the image forming apparatus.

The image forming apparatus 1000 further includes a controller 500 (see FIG. 12). The controller 500 issues an instruction of rotation in a unit of the number of pulses, to the switching motor 231 that is a stepping motor in the present embodiment, so as to drive the switching motor 231. A driving force of the switching motor 231 is transmitted to the switching claw 205 via the drive gear 233 and the driven gear 234, so that the switching claw 205 located at the sheet ejection guide position rotates in the counterclockwise direction in FIG. 7, as indicated by arrow A1 in FIG. 7. As the switching claw 205 rotates, the feeler 232*a* rotates together with the switching claw 205 in the counterclockwise direction. Along with this rotation, the feeler 232*a* enters between the light emitting element and the light receiving element of the transmission optical sensor 232*b*, blocking light of the light emitting element.

As the switching claw 205 rotates in the counterclockwise direction in FIG. 7, the feeler 232*a* passes through between the light emitting element and the light receiving element of the transmission optical sensor 232*b*. Then, the light of the light emitting element is received by the light receiving element, and the switching claw position detector 232 detects that the switching claw 205 has reached the sheet reverse guide position. After the switching claw position detector 232 detects that the switching claw 205 has reached the sheet reverse guide position, the controller 500 (see FIG. 12) causes the switching motor 231 to stop driving (rotating).

When rotating the switching claw 205 from the sheet reverse guide position to the sheet ejection guide position, the switching motor 231 is driven to rotate in the reverse direction that is a direction opposite the forward direction of rotation of the switching motor 231. Along with the reverse rotation of the switching motor 231, the switching claw 205 is rotated in the clockwise direction in FIG. 7. Then, as described above, when the feeler 232*a* passes through the transmission optical sensor 232*b*, the switching claw position detector 232 detects that the switching claw 205 has reached the sheet ejection guide position. In response to this detection by the switching claw position detector 232, the controller 500 causes the switching motor 231 to stop driving (rotating).

In the present embodiment, by switching the direction of rotation of the switching motor 231 between the clockwise direction and the counterclockwise direction in FIG. 7, the switching claw 205 is rotated in the clockwise direction or the counterclockwise direction. However, the configuration applicable to this disclosure is not limited to the above-described configuration. For example, the sheet conveying device 100 may include a first drive transmission passage having the even number of gears to rotate the switching claw 205 in one direction and a second drive transmission passage having the odd number of gears to rotate the switching claw 205 in a direction opposite to the one direction. Both the first drive transmission passage and the second drive transmission passage include respective clutches. By switching the switching claw 205 according to switching of the clutches, the switching claw 205 may be rotated in the clockwise direction or in the counterclockwise direction in FIG. 7. In this configuration, the switching claw 205 is rotated in the clockwise direction or in the counterclockwise direction in FIG. 7 without switching the direction of rotation of the switching motor 231.

In the present embodiment, the sheet conveying device 100 includes the switching claw position detector 232. However, a configuration in which a stepping motor is employed as the switching motor 231 may omit the switching claw position detector 232. In this case, the pulse signal (the number of pulses) to be input to the switching motor is counted and, when the counted pulse signal reaches the specified value, it is determined that the switching claw 205 has reached from one position of the sheet reverse guide position and the sheet ejection guide position, to the other position. However, if the configuration includes a switching claw position detector, even when a power source is turned off while the switching claw 205 is in rotation, the position of the switching claw 205 is detected easily. Therefore, it is preferable that the configuration includes a switching claw position detector.

Further, when the switching motor 231 employs a stepping motor, the sheet reverse guide position and the sheet ejection guide position are adjusted reliably, in other words, the sheet reverse guide position that functions as a first position and the sheet ejection guide position that functions as a second position are adjustable. Specifically, as a given number of pulses to be input to the switching motor 231 is changed according to the amount of movement of the switching claw 205 from the sheet reverse guide position to the sheet ejection guide position, the sheet ejection guide position is adjusted. Similarly, as a given number of pulses to be input to the switching motor 231 is changed according to the amount of movement of the switching claw 205 from the sheet ejection guide position to the sheet reverse guide position, the sheet reverse guide position is adjusted. In this configuration, whether the switching claw 205 has reached the sheet reverse guide position or the sheet ejection guide position is determined based on the number of pulses input to the switching motor 231. Further, if an encoder is provided to the configuration of the sheet conveying device 100, even when the switching motor 231 is not a stepping motor, the sheet reverse guide position and the sheet ejection guide position are adjusted as described above.

Accordingly, by adjusting the position of the sheet reverse guide position and the sheet ejection guide position, a course of flow of cooling air guided by the switching claw 205 and a sheet conveyance direction of a sheet P guided by the switching claw 205 are adjusted.

Further, as illustrated in FIG. 7, the switching claw 205 includes an edge 205*b* having a comb-teeth shape with a plurality of recesses 205*c* disposed at given intervals in the sheet width direction.

Figure 8A:
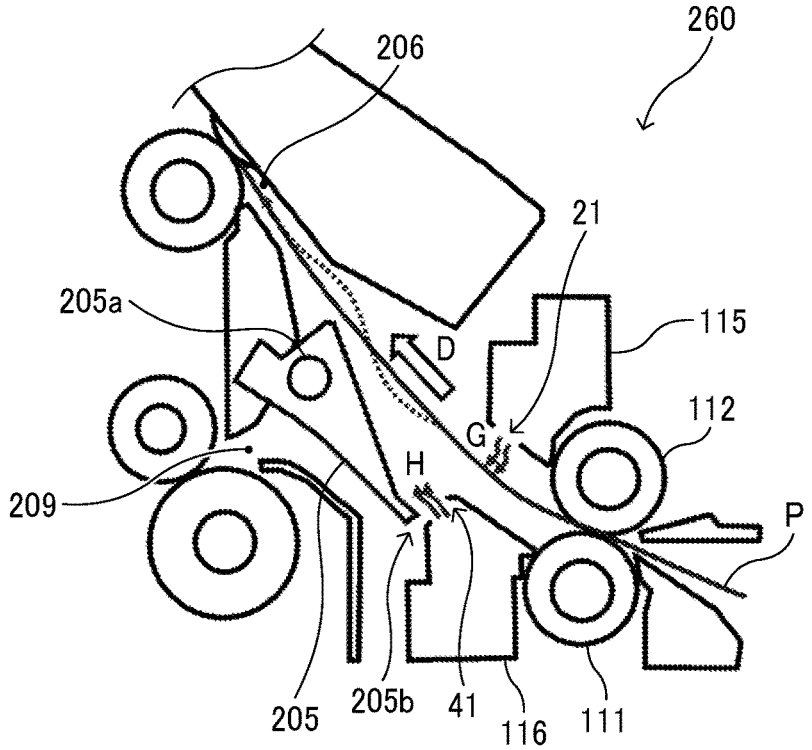
FIG. 8A is a diagram illustrating a state in which a sheet is conveyed to a sheet ejection passage.
Figure 8B:
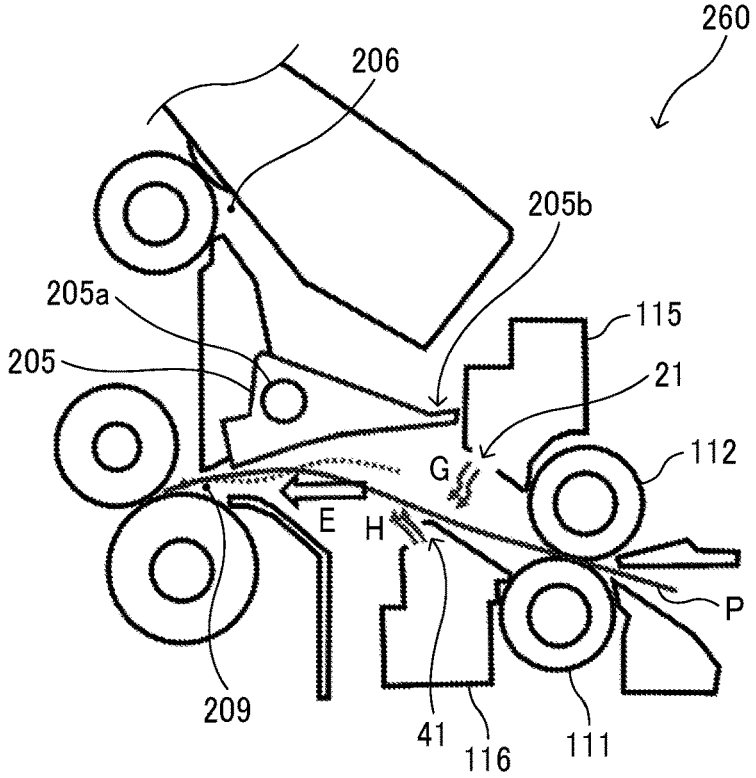
FIG. 8B is a diagram illustrating a state in which the sheet is conveyed to a sheet reverse passage.

FIG. 8A is a diagram illustrating a state in which the sheet P is conveyed to the sheet ejection passage 206. FIG. 8B is a diagram illustrating a state in which the sheet P is conveyed to the sheet reverse passage 209.

As illustrated in FIG. 8A, no pair of rollers is disposed between the switching claw 205 and the plurality of lower conveyance passage blowout ports 41 and the plurality of upper conveyance passage blowout ports 21. Therefore, the cooling air blown out from the plurality of lower conveyance passage blowout ports 41 and the plurality of upper conveyance passage blowout ports 21 flows to the switching claw 205 reliably. When the switching claw 205 is at the sheet ejection guide position, the edge 205*b* of the switching claw 205 is located lower than the plurality of lower conveyance passage blowout ports 41 of lower air duct 116 and farther from the sheet conveyance passage, than the plurality of lower conveyance passage blowout ports 41. Accordingly, the cooling air blown out from the plurality of lower conveyance passage blowout ports 41 is guided by the switching claw 205 into the sheet ejection passage 206. On the other hand, the cooling air blown out from the plurality of upper conveyance passage blowout ports 21 flows, together with the sheet P being conveyed, in a direction indicated by arrow D, into the sheet ejection passage 206.

Accordingly, the cooling air blown out from the plurality of upper conveyance passage blowout ports 21 and the cooling air blown out from the plurality of lower conveyance passage blowout ports 41 are flown to the sheet ejection passage 206 that is a sheet guide destination of the switching claw 205.

When the sheet conveyance speed is too fast to cool the sheet P sufficiently before the sheet P reaches the switching claw 205, it is likely that heat of the sheet P transmits to conveyance guides and pairs of conveyance rollers provided in the sheet ejection passage 206 to increase the temperature of the conveyance guides and the pairs of conveyance rollers. However, as described above, the cooling air blown out from the plurality of upper conveyance passage blowout ports 21 and the cooling air blown out from the plurality of lower conveyance passage blowout ports 41 flow to the sheet ejection passage 206 together with conveyance of the sheet P, so that the cooling airs preferably cool the conveyance guide and the pair of sheet conveying rollers (the pair of sheet ejection rollers) provided in the sheet ejection passage 206. Consequently, the conveyance guide and the pair of sheet conveying rollers provided in the sheet ejection passage 206 is restrained from the increase in temperature, thereby restraining the conveyance guide and the pair of sheet conveying rollers provided in the sheet ejection passage 206 from deterioration in effect of taking heat of the sheet P. Accordingly, even in high-speed sheet conveyance, the sheet P is cooled reliably in the image forming apparatus 1000, and therefore the temperature of the sheet P to be ejected outside the image forming apparatus 1000 is restrained reliably.

Further, as illustrated in FIG. 8B, when the switching claw 205 is at the sheet reverse guide position at the return guide position, the edge 205*b* of the switching claw 205 is located higher than the plurality of upper conveyance passage blowout ports 21 of the upper air duct 115 and farther from the sheet conveyance passage, than the plurality of upper conveyance passage blowout ports 21. Accordingly, the cooling air blown out from the plurality of upper conveyance passage blowout ports 21 is guided by the switching claw 205 into the sheet reverse passage 209.

When the switching claw 205 is located at the sheet reverse guide position, the cooling air blown out from the plurality of lower conveyance passage blowout ports 41 is guided by the sheet P being conveyed, flowing into the sheet reverse passage 209, as indicated by arrow E in FIG. 8B.

Thus, the cooling air blown out from the plurality of upper conveyance passage blowout ports 21 and the cooling air blown out from the plurality of lower conveyance passage blowout ports 41 flow into the sheet reverse passage 209 that is a sheet guide destination of the switching claw 205. Therefore, the conveyance guide and the pair of sheet conveying rollers provided in the sheet reverse passage 209 are cooled reliably. Even when the sheet conveyance speed is too fast to cool the sheet P sufficiently before the sheet P reaches the switching claw 205, the conveyance guide and the pair of sheet conveying rollers provided in the sheet reverse passage 209 are restrained from an increase in temperature. Consequently, the conveyance guide and the pair of sheet conveying rollers provided in the sheet reverse passage 209 is restrained from the increase in temperature, thereby restraining the conveyance guide and the pair of sheet conveying rollers provided in the sheet reverse passage 209 from deterioration in effect of taking heat of the sheet P. Accordingly, the sheet P is cooled reliably before the sheet P is conveyed to the image forming device 2 again, and therefore each unit in the image forming device 2 is prevented from an increase in temperature due to heat of the sheet P that is conveyed to the image forming device 2 again.

Figure 9A:
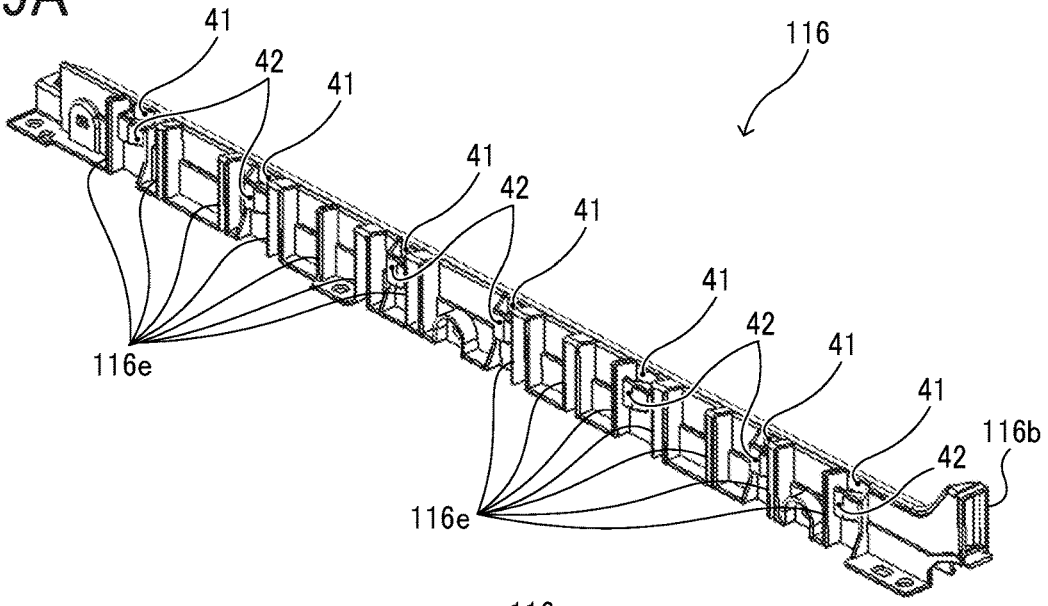
FIGS. 9A, 9B, 9C, and 9D illustrate diagrams of a lower air duct.
Figure 9B:
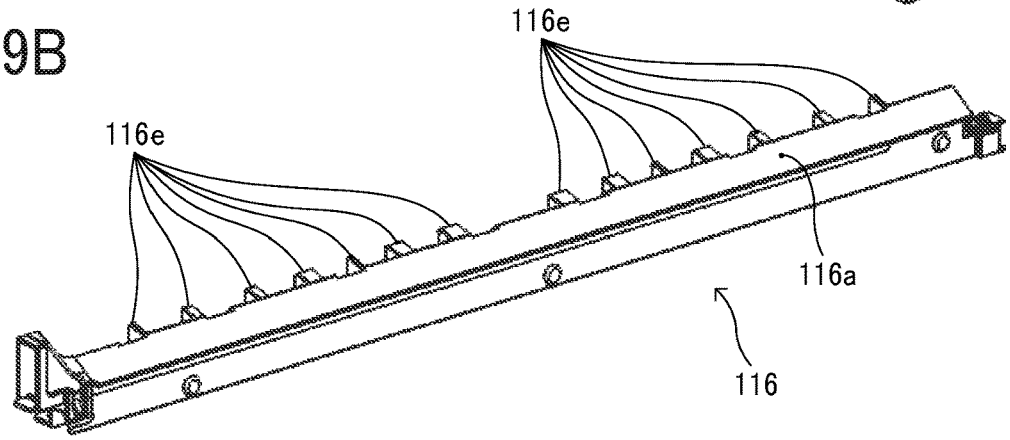
Figure 9C:
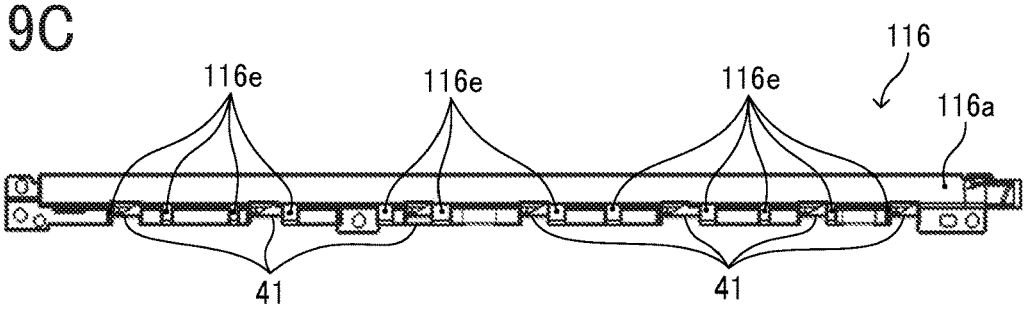
Figure 9D:
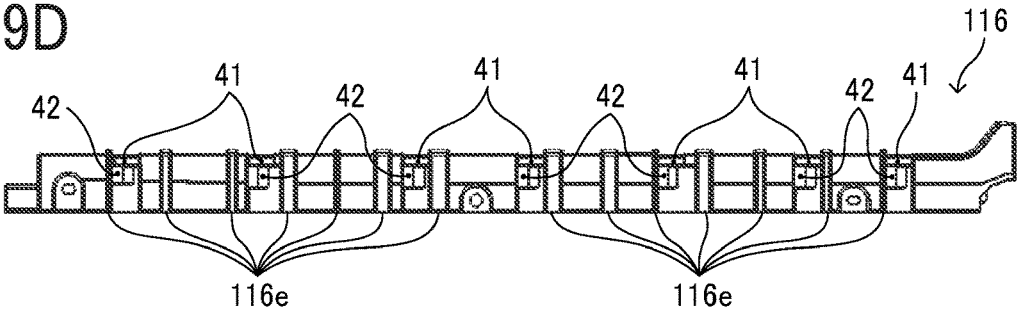

FIGS. 9A, 9B, 9C, and 9D illustrate diagrams of the lower air duct 116. Specifically, FIG. 9A is a perspective view illustrating the lower air duct 116 viewed from the downstream side in the sheet conveyance direction. FIG. 9B is a perspective view illustrating the lower air duct 116 viewed from the upstream side in the sheet conveyance direction. FIG. 9C is a plan view of the lower air duct 116. FIG. 9D is a side view of the lower air duct 116 viewed from the downstream side in the sheet conveyance direction.

The lower air duct 116 further includes a plurality of air exhaust ports 42 disposed at downstream side ends in the sheet conveyance direction. The plurality of air exhaust ports 42 is aligned on the downstream side in the sheet conveyance direction, at given intervals along the duct longitudinal direction (in other words, the axial direction, the sheet width direction, the front-and-back direction of the image forming apparatus, and the direction of flow of cooling air). The plurality of air exhaust ports 42 exhausts the cooling air in the lower air duct 116 from the plurality of lower conveyance passage blowout ports 41. The plurality of lower conveyance passage blowout ports 41 is provided on the upper part of the plurality of air exhaust ports 42, respectively.

Furthermore, the lower air duct 116 includes a lower receiving port 116*b* at one longitudinal end. The lower receiving port 116*b* is communicated with the communication pipe 123 to receive the cooling air from the communication pipe 123. Further, the lower air duct 116 further includes a lower sheet guide face 116*a* to guide the lower face of the sheet P. The lower sheet guide face 116*a* is sloped upward toward downstream in the sheet conveyance direction. In other words, the lower sheet guide face 116*a* is inclined upward in the sheet conveyance direction. As illustrated in FIG. 9A, each edge of the plurality of lower conveyance passage blowout ports 41 is sloped downward toward downstream in the sheet conveyance direction. In other words, the edge of the plurality of lower conveyance passage blowout ports 41 is inclined downward in the sheet conveyance direction. Thus, by inclining the edge of the plurality of lower conveyance passage blowout ports 41 downward toward the sheet conveyance direction, the sheet P is restrained from being caught by the edge of the plurality of lower conveyance passage blowout ports 41. Consequently, sheet edge folding is prevented.

The lower air duct 116 further includes a plurality of ribs 116*e* at the downstream end of the lower air duct 116. The plurality of ribs 116*e* are provided at given intervals in the longitudinal direction of the lower air duct 116.

Figure 10A:
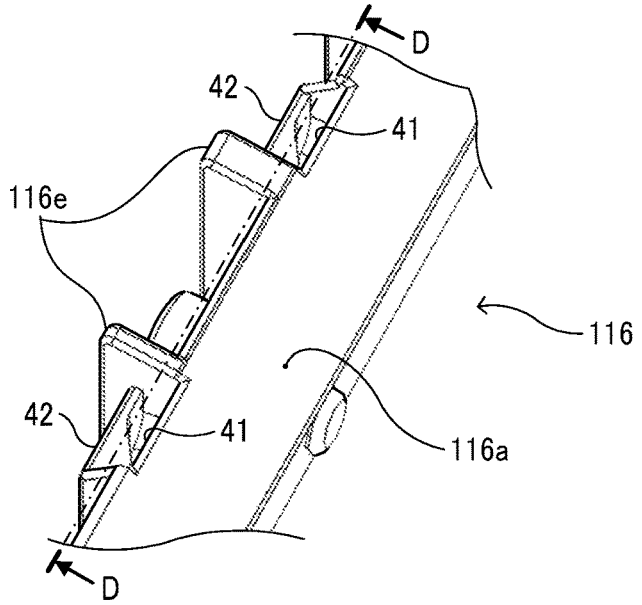
FIG. 10A is an enlarged perspective view illustrating the lower air duct.
Figure 10B:
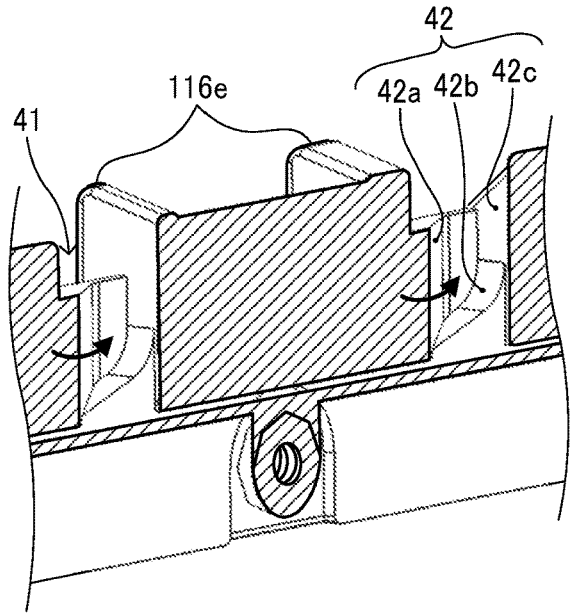
FIG. 10B is a perspective cross-sectional view illustrating the lower air duct of FIG. 10A, along a line D-D.
Figure 10C:
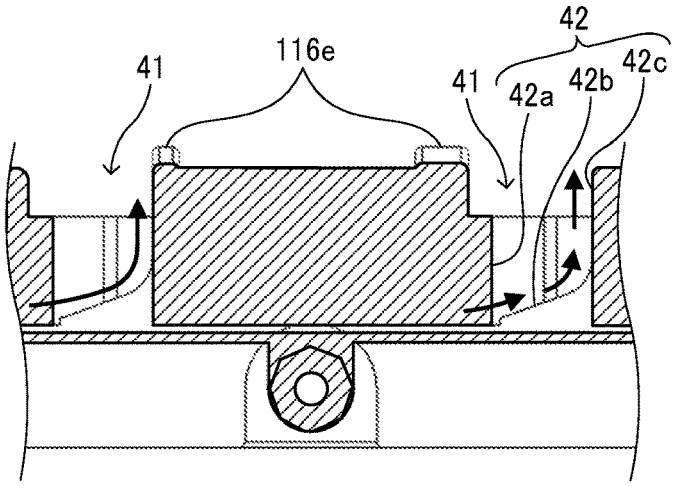
FIG. 10C is a cross-sectional view illustrating the lower air duct of FIG. 10A, along the line D-D.

FIGS. 10A 10B, and 10C are diagrams illustrating the lower air duct 116. To be more specific, FIG. 10A is an enlarged perspective view illustrating the lower air duct 116. FIG. 10B is a perspective cross-sectional view illustrating the lower air duct 116 of FIG. 10A, along a line D-D. FIG. 10C is a cross-sectional view illustrating the lower air duct 116 of FIG. 10A, along the line D-D.

Hereinafter, the plurality of air exhaust ports 42 is collectively referred to in a singular form as the air exhaust port 42, for convenience, to describe each of the plurality of air exhaust ports 42. Similarly, the plurality of lower conveyance passage blowout ports 41 is collectively referred to in a singular form as the lower conveyance passage blowout port 41, for convenience, to describe each of the plurality of lower conveyance passage blowout ports 41.

The air exhaust port 42 has a wall 42*c* provided orthogonal to the longitudinal direction of the lower air duct 116. The wall 42*c* blocks the cooling air in the lower air duct 116 that has flown to the air exhaust port 42, so that the blocked cooling air is blown out from the lower conveyance passage blowout port 41 provided on the upper part of the air exhaust port 42. The air exhaust port 42 also has a first sloped portion 42*a* and a second sloped portion 42*b*. The first sloped portion 42*a* is disposed upstream from the wall 42*c* in the air flow direction in the lower air duct 116 and inclined to the longitudinal direction of the lower air duct 116.

As illustrated in FIG. 10B, the first sloped portion 42*a* is provided on the side wall of the air exhaust port 42, declining to the downstream side in the sheet conveyance direction toward downstream in the air flow direction in the lower air duct 116. The first sloped portion 42*a* is preferably provided to restrain pressure loss of the cooling air that has flown to the air exhaust port 42, thereby restraining a decrease in the air flowing speed of the cooling air. Consequently, this configuration restrains a decrease in force of blowout of the cooling air from the lower conveyance passage blowout port 41.

As illustrated in FIG. 10C, the second sloped portion 42*b* gradually increases in height toward downstream in the air flow direction in the lower air duct 116, connecting to the wall 42*c*. In the present embodiment, the second sloped portion 42*b* has an arc shape. With this configuration, the cooling air flown to the air exhaust port 42 is guided upward along the second sloped portion 42*b*, as indicated by arrows illustrated in FIG. 8C. Consequently, pressure loss is restrained, thereby restraining a decrease in force of blowout of the cooling air from the lower conveyance passage blowout port 41 provided on the upper part of the air exhaust port 42.

Figure 11A:
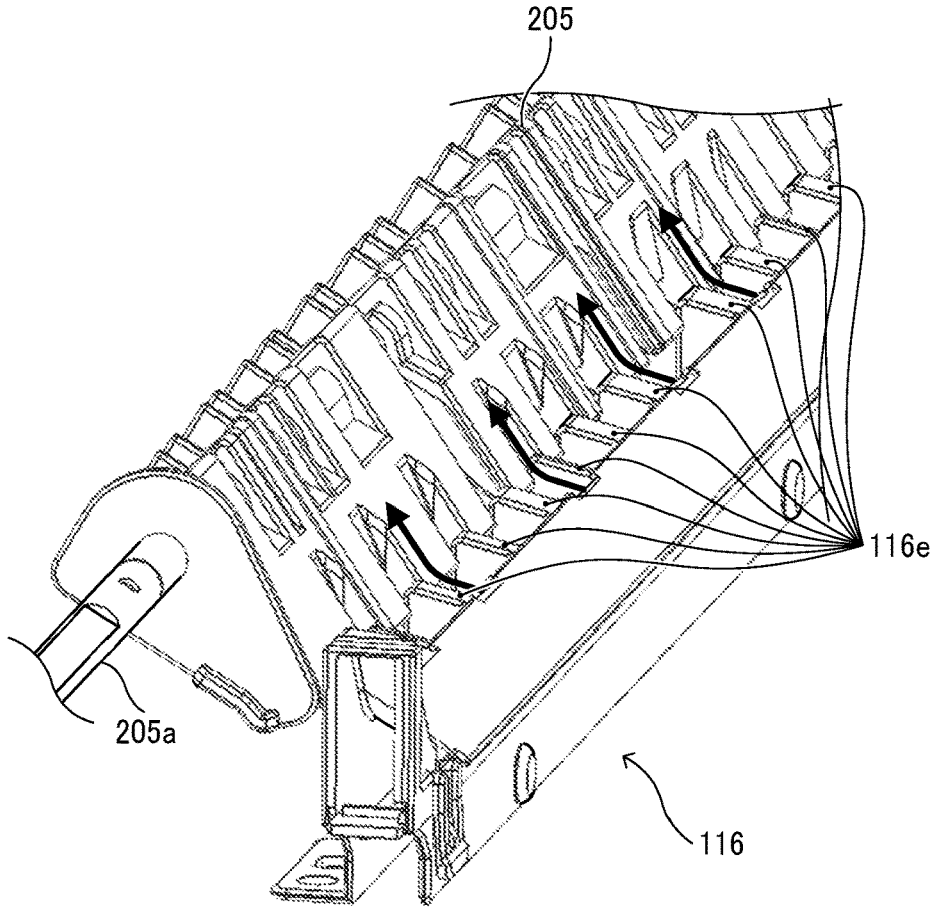
FIG. 11A is a perspective view illustrating the switching claw disposed at a sheet ejection guide position and the lower air duct.
Figure 11B:
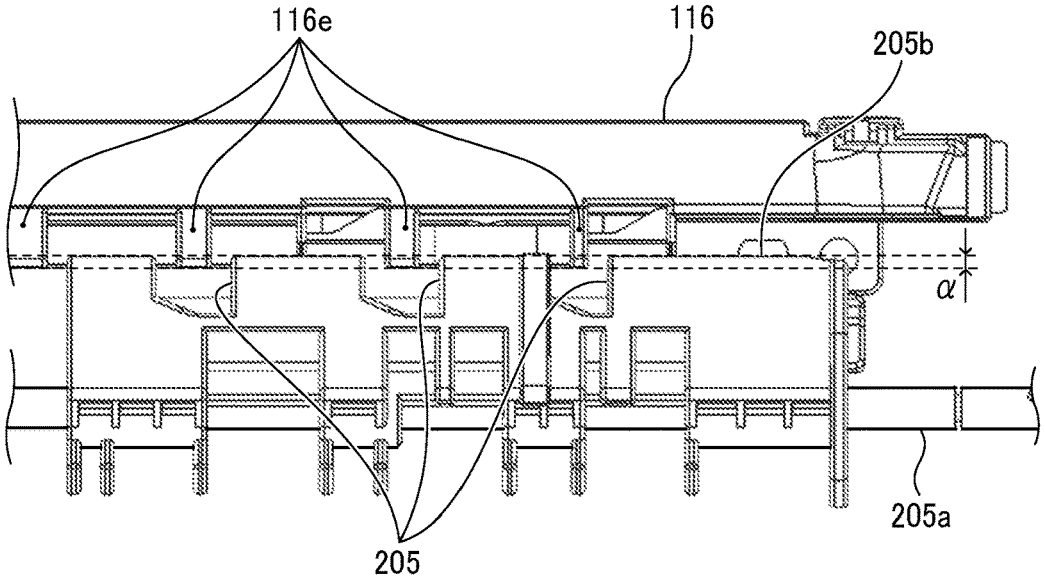
FIG. 11B is a plan view illustrating the switching claw disposed at the sheet ejection guide position and the lower air duct.

FIG. 11A is a perspective view illustrating the switching claw 205 disposed at the sheet ejection guide position and the lower air duct 116. FIG. 11B is a plan view illustrating the switching claw 205 disposed at the sheet ejection guide position and the lower air duct 116.

As illustrated in FIGS. 11A and 11B, when the switching claw 205 is at the sheet ejection guide position, the edge of the switching claw 205 enters between the plurality of ribs 116*e* of the lower air duct 116, and each of the plurality of ribs 116*e* enters a corresponding one of the plurality of recesses 205*c* of the switching claw 205. Therefore, the edge of the switching claw 205 and a part of the lower air duct 116 are disposed alternately in the sheet width direction, in other words, the edge of the switching claw 205 and a part of the lower air duct 116 are disposed in an alternate order in the sheet width direction (see reference symbol "a" in FIG. 11B).

Accordingly, the leading end of a sheet guided by the lower sheet guide face 116*a* of the lower air duct 116 is prevented from being caught by the edge of the switching claw 205, and therefore occurrence of sheet edge folding error or occurrence of conveyance failure is prevented.

Since the air exhaust port 42 having the lower conveyance passage blowout port 41 is disposed projecting toward downstream in the sheet conveyance direction, in a case in which the edge 205*b* of the switching claw 205 is not a comb-teeth shape, a gap increases between a portion having no air exhaust port 42 on the lower air duct 116 and the edge 205*b* of the switching claw 205. Due to this structure, the cooling air flowing in the duct longitudinal direction, out of the cooling air blown out from the plurality of lower conveyance passage blowout ports 41, leaks from the gap between the portion having no air exhaust port 42 on the lower air duct 116 and the edge 205*b* of the switching claw 205, which may result in a decrease in the amount of the cooling air flowing into the sheet ejection passage 206.

However, as in the present embodiment, the edge 205*b* of the switching claw 205 has a comb-teeth shape, so that the plurality of ribs 116*e* of the lower air duct 116 is fitted to the switching claw 205. According to this structure, among the plurality of ribs 116*e*, two adjacent ribs 116*e* aligned across the lower conveyance passage blowout port 41 block the cooling air blown out from the lower conveyance passage blowout port 41 to prevent flowing in the duct longitudinal direction, and therefore the cooling air blown out from the lower conveyance passage blowout port 41 is flown along the switching claw 205 (as indicated by arrows in FIG. 11A). Further, the gap between the portion having no air exhaust port 42 on the lower air duct 116 and the edge 205*b* of the switching claw 205 is reduced (narrowed). Accordingly, the cooling air blown out from the lower conveyance passage blowout port 41 is restrained from leaking from between the lower air duct 116 and the edge 205*b* of the switching claw 205. Accordingly, this structure prevents a decrease in the amount of flow of the cooling air blown out from the lower conveyance passage blowout port 41 to flow into the sheet ejection passage 206, thereby cooling the conveyance guide and the pair of sheet conveying rollers provided in the sheet ejection passage 206 reliably.

Similar to the lower air duct 116, the upper air duct 115 may include a plurality of ribs, so that, when the switching claw 205 is at the sheet reverse guide position, the edge of the switching claw 205 and a part of the upper air duct 115 may be disposed alternately in the sheet width direction, in other words, the edge of the switching claw 205 and a part of the upper air duct 115 may be disposed in an alternate order in the sheet width direction. With this configuration, the cooling air blown out from each of the plurality of upper conveyance passage blowout port 21 is flown to the sheet reverse passage 209 reliably. Hereinafter, the plurality of upper conveyance passage blowout ports 21 is collectively referred to in a singular form as the upper conveyance passage blowout port 21, for convenience.

FIG. 12 is a block diagram illustrating a part of an electric circuit in the image forming apparatus 1000.

In FIG. 12, the controller 500 includes a central processing unit (CPU) that functions as an operation unit. The controller 500 further includes memories such as a random-access memory (RAM) and read only memory (ROM). The controller 500 controls the whole devices and units of the image forming apparatus 1000. Although various devices and sensors are connected to the controller 500, the diagram of FIG. 12 illustrates main devices that control, for example, the air blowing fan 124 and the switching claw 205.

The controller 500 controls each device and unit based on a control program stored in the RAM and the ROM. The controller 500 controls the output (duty cycle) of the air blowing fan 124 and the turn ON and turn OFF of the air blowing fan 124 based on the detection results of the registration roller exit sensor 130 and the fixing device exit sensor 131 and the sheet type information input in the control panel 400.

When it is detected that the sheet bank 201 or the sheet feed tray 202 is attached to or detached from the housing of the image forming apparatus 1000, the controller 500 issues an message on the control panel 400 to encourage a user to input the sheet type information via the control panel 400. Hereinafter, the sheet bank 201 and the sheet feed tray 202 are collectively referred to as a sheet container. Then, the user inputs the sheet type information set in the sheet bank 201 or the sheet feed tray 202 (such as the brand, thickness (weight), and type (coated paper, plain paper, etc.) based on the information displayed on the control panel 400. In response to the input of the sheet type information, the controller 500 stores the sheet type information to a non-volatile memory in association with the sheet feed tray 202 or the sheet bank 201.

Figures 13, 13A:
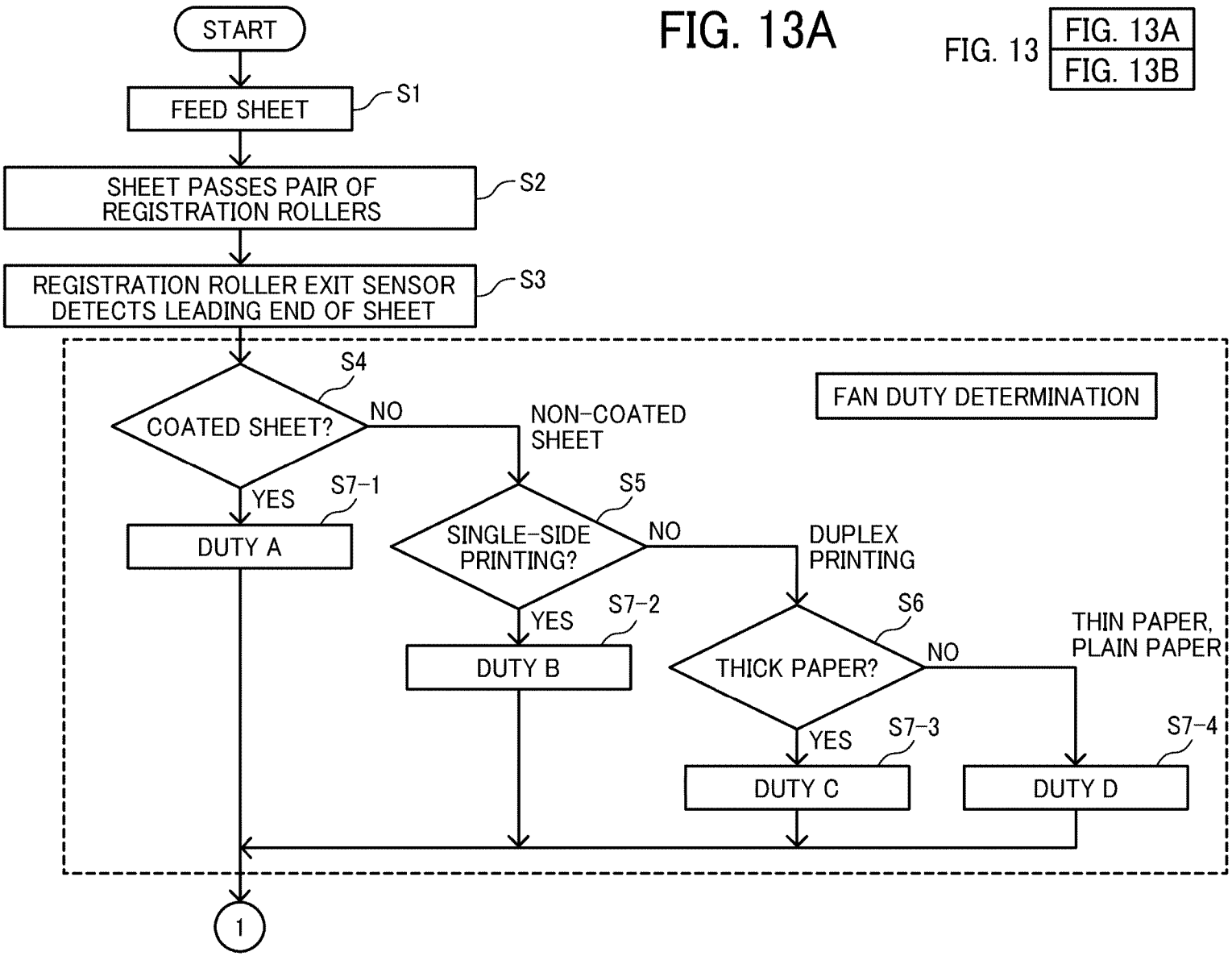
FIG. 13 (divided into FIGS. 13A and 13B) is a control flowchart of an air blowing fan.
Figure 13B:
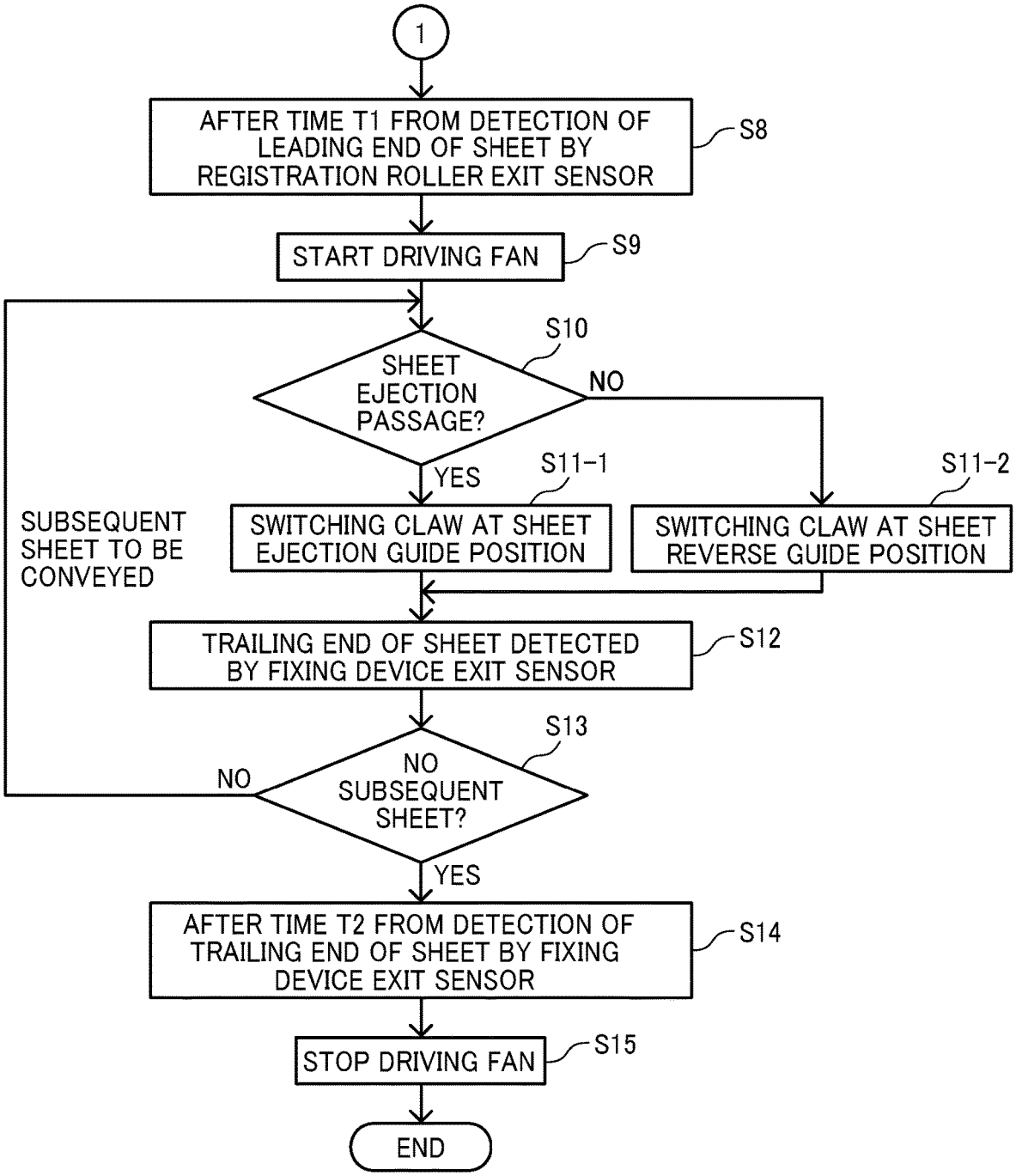

FIG. 13 (divided into FIGS. 13A and 13B) is a control flowchart of the air blowing fan 124.

The sheet P is fed from the sheet bank 201 or the sheet feed tray 202 (step S1) and passes through the pair of sheet registration rollers 102 (step S2).

When registration roller exit sensor 130 that functions as a sheet sensor detects the leading end of the sheet P (in other words, the registration roller exit sensor 130 detects state changing from a non-sheet detection state (sensor OFF) to a sheet detection state (sensor ON)) (step S3), the controller 500 determines the outputs (duty cycle) of the air blowing fan 124 (steps S4 to S7-1 to 7-4). The procedures of steps S4 to 7-4 are collectively referred to as fan duty determination.

The controller 500 reads the sheet type information corresponding to the sheet container from which the sheet P is fed and determines the outputs (duty cycle) of the air blowing fan 124 based on the read sheet type information. Specifically, as illustrated in the flowchart of FIG. 13 (FIGS. 13A and 13B), the controller 500 determines whether the sheet P conveyed to the registration roller exit sensor 130 is a coated paper or not (step S4).

When the sheet P is a coated paper (YES in S4), the controller 500 determines that the duty cycle is Duty A (step S7-1).

On the other hand, when the sheet P is a non-coated paper (NO in step S4), the controller 500 determines whether the sheet P is subject to single-side printing (step S5).

When the sheet P is subject to single-side printing (YES in step S5), the controller 500 determines that the duty cycle is Duty B (step S7-2).

On the other hand, when the sheet P is not subject to single-side printing but is subject to duplex printing (NO in step S5), the controller 500 determines whether the sheet P is a thick paper (step S6).

When the sheet P is a thick paper (YES in step S6), the controller 500 determines that the duty cycle is Duty C (step S7-3).

On the other hand, when the sheet P is subject to duplex printing (NO in step S5) and the sheet P is not a thick paper but a thin paper (NO in step S6), the controller 500 determines that the duty cycle is Duty D (step S7-4).

An example of the relation between the duty cycles to be determined by the controller 500 is represented as Duty Cycle A>Duty Cycle C>Duty Cycle D>Duty Cycle B.

Coated paper is more likely to cause a blocking phenomenon than non-coated paper. Therefore, the duty cycle A for the coated paper is set to be greater than a duty cycle for the other papers, so that the amount of air blown out from each of the upper conveyance passage blowout port 21 and the lower conveyance passage blowout port 41. In other words, the controller 500 changes the amount of air blown out from the upper conveyance passage blowout port 21 according to the type of a sheet. Further, the controller 500 changes the amount of air blown out from the lower conveyance passage blowout port 41 according to the type of a sheet. Accordingly, the sheet is cooled more.

In the duplex printing, the sheet P passes the fixing device two (2) times, which makes the temperature of the sheet P increase more easily than the temperature of the sheet P in the single-side printing. Therefore, the duty cycle C and the duty cycle D set for the duplex printing are greater than the duty cycle B set for the single-side printing. With this configuration, the amount of air blown out from each of the upper conveyance passage blowout port 21 and the lower conveyance passage blowout port 41 increases in the duplex printing, so that the sheet P is cooled reliably, thereby restraining occurrence of toner blocking. In other words, the controller 500 changes an amount of air blown out from the first air blowing port according to whether the printing mode is the single-side printing or the duplex printing. Further, the controller 500 changes an amount of air blown out from the second air blowing port according to whether the printing mode is the single-side printing or the duplex printing. In addition, thick paper has a larger heat capacity than plain paper and thin paper, and therefore is less likely to decrease in temperature. Therefore, in duplex printing, the duty cycle C for thick paper is set to be greater than the duty cycle D for plain paper or thin paper.

Further, the duty cycle in single-side printing is not limited to set to be the duty cycle B regardless of sheet thickness, as described above. For example, the duty cycle in single-side printing may be set to a duty cycle appropriate to the sheet thickness. Also in this case, the duty cycle for thick paper is set to be larger than the duty cycle for thin paper or plain paper. The duty cycle for coated paper is set to the duty cycle A in both single-side printing and duplex printing. However, the duty cycle for coated paper in the duplex printing may be set greater than the duty cycle for coated paper in the single-side printing.

Further, in the present embodiment, an example of the relation of the duty cycles is set to Duty Cycle A>Duty Cycle C>Duty Cycle D>Duty Cycle B. However, the relation of the duty cycles may be determined accordingly, based on the configuration, for example.

Further, in the present embodiment, when the registration roller exit sensor 130 detects the leading end of the sheet P, the duty cycle of the air blowing fan 124 is determined. However, the duty cycle may be determined when feeding the sheet P.

In the present embodiment, the sheet type information, based on which the duty cycle of the air blowing fan 124 is determined, is obtained when a user input information via the control panel 400. Alternatively, for example, a sheet type detector is provided to detect the type of a sheet conveyed toward downstream from the pair of sheet registration rollers 102 in the sheet conveyance direction. Accordingly, the duty cycle of the air blowing fan 124 may be determined based on the detection result by the sheet type detector. For example, coated paper has a surface smoother than the surface of non-coated paper and has reflectance different from the reflectance of the non-coated paper. Therefore, detection of the reflectance of a sheet conveyed from the upstream side in the sheet conveyance direction by the reflective optical sensor determines whether the sheet is a coated paper or a non-coated paper. Further, thick paper, plain paper, and thin paper have different reflectance values. Therefore, as the transmission optical sensor detects the reflectance of light of the sheet conveyed from the upstream side in the sheet conveyance direction, the thickness of the sheet is detected.

Next, after a time T1 has elapsed from when the registration roller exit sensor 130 has detected the leading end of the sheet (step S8), the controller 500 starts driving the air blowing fan 124 with the duty cycle determined in steps S7-1 to 7-4 (step S9).

In the present embodiment, the air blowing fan 124 is started to drive at any timing before the leading end of the sheet reaches the conveyance cooling unit 110. By reducing (shortening) the time T1 and driving the air blowing fan 124 at an early stage, the cooling air blown out from the upper conveyance passage blowout port 21 or the lower conveyance passage blowout port 41 is flown to the sheet ejection passage 206 or the sheet reverse passage 209, thereby cooling the conveyance guide and the pair of sheet conveying rollers provided in the sheet ejection passage 206 and the sheet reverse passage 209 reliably.

Alternatively, the time T1 may be set optionally by a user operating the control panel 400 by setting a time up to an upper limit time from when the registration roller exit sensor 130 detects the leading end of a sheet to when at least the leading end of the sheet reaches the conveyance cooling unit 110. By increasing (extending) the time T1, the power consumption of the image forming apparatus 1000 is restrained. As described above, by reducing (shortening) the time T1, the conveyance guide and the pair of sheet conveying rollers provided in the sheet ejection passage 206 or the sheet reverse passage 209 are cooled, thereby restraining occurrence of toner blocking reliably.

In the present embodiment, the sheet sensor (i.e., the registration roller exit sensor 130) that triggers the start of driving of the air blowing fan 124 is provided at a position that is sufficiently separated from the conveyance cooling unit 110 toward upstream in the sheet conveyance direction. In other words, the registration roller exit sensor 130 is disposed upstream from the upper air duct 115 and the lower air duct 116 in the sheet conveyance direction. According to this configuration, a considerable time is saved from when the sheet sensor (i.e., the registration roller exit sensor 130)

detects the leading end of the sheet to when the leading end of the sheet reaches the conveyance cooling unit 110. Thus, a certain range is given to the start timing of driving of the air blowing fan 124, and therefore an optional time is set for the time T1.

Next, when the controller 500 determines whether the sheet is conveyed to the sheet ejection passage 206 (step S10).

When the sheet is conveyed to the sheet ejection passage 206 (YES in step S10), the controller 500 causes the switching claw 205 to be located at the sheet ejection guide position (step S11-1).

The controller 500 determines whether the switching claw 205 is located at the sheet ejection guide position based on the previous direction of rotation of the switching motor 231 and the detection result of the switching claw position detector 232. Specifically, in a case in which the transmission optical sensor 232*b* does not detect the feeler 232*a* and the switching motor 231 is rotated in the clockwise direction in FIG. 7 at the previous detection of the switching motor 231, the controller 500 determines that the switching claw 205 is located at the sheet ejection guide position. According to the determination, the controller 500 does not drive the switching motor 231. In other states, the controller 500 determines that the switching claw 205 is not located at the sheet ejection guide position. Based on the determination, the controller 500 drives the switching motor 231 to rotate the switching claw 205 to the sheet ejection guide position.

On the other hand, when the sheet is not conveyed to the sheet ejection passage 206 but when the sheet is conveyed to the sheet reverse passage 209 in a case in which the sheet has an image on one side in the duplex printing mode or in which the sheet is ejected to the sheet stacker 208 with face down (NO in step S10), the controller 500 causes the switching claw 205 to be located at the sheet reverse guide position (step S11-2).

The controller 500 checks that the transmission optical sensor 232*b* has not detected the feeler 232*a* and whether the switching motor 231 has rotated in the counterclockwise direction in FIG. 7 or not at the previous driving of the switching motor 231. When the transmission optical sensor 232*b* has not detected the feeler 232*a* and the switching motor 231 has rotated in the counterclockwise direction in FIG. 7 at the previous driving of the switching motor 231, the controller 500 determines that the switching claw 205 is located at the sheet reverse guide position, and therefore does not drive the switching motor 231. In other states, the controller 500 determines that the switching claw 205 is not located at the sheet reverse guide position. Based on the determination, the controller 500 drives the switching motor 231 to rotate the switching claw 205 to the sheet reverse guide position.

Alternatively, the sheet reverse guide position or the sheet ejection guide position may be a default position. According to this position, when the trailing end of the sheet passes the switching claw 205 the controller 500 may cause the switching claw 205 to return to the default position. In this case, for example, in a case in which the default position is the sheet reverse guide position, the controller 500 drives the switching motor 231 to rotate the switching claw 205 to the sheet ejection guide position when the sheet is conveyed to the sheet ejection passage 206 and, on the other hand, the controller 500 does not drive the switching motor 231 when the sheet is conveyed to the sheet reverse passage 209.

Further, in the control flowchart of FIG. 13, the controller 500 starts driving the air blowing fan 124 and then rotates the switching claw 205 to a given position. However, the control timing to move the switching claw 205 to the given position may be a timing at which the switching claw 205 completes movement to the given position before the trailing end of the sheet reaches the switching claw 205.

After step S11-1 or S11-2, the fixing device exit sensor 131 detects the trailing end of the sheet (step S12). Then, the controller 500 determines whether there is no subsequent sheet (step S13).

When there is a subsequent sheet (NO in step S13), the process returns to step S10. When the fixing device exit sensor 131 has detected the trailing end of the sheet (step S12) and it is determined that there is no more subsequent sheet (YES in step S13), the controller 500 stands by for a time T2.

After the time T2 has elapsed from when the trailing end of the sheet passed the fixing device exit sensor 131, in other words, after the time T2 from detection of the trailing end of the sheet by the fixing device exit sensor 131 (step S14), the controller 500 causes the air blowing fan 124 to stop driving (step S15).

The time T2 is set longer than a time from when the fixing device exit sensor 131 detects the trailing end of the sheet (when a sheet detection state (ON state) is switched to a sheet non-detection state (OFF state)), to when the trailing end of the sheet passes the switching claw 205. By so doing, the cooling air blown out from the upper conveyance passage blowout port 21 and the cooling air blown out from the lower conveyance passage blowout port 41 are blown over the entire region from the leading end to the trailing end of the sheet, and therefore the sheet is cooled over the entire range.

The time T2 may be set optionally by a user via the control panel 400, with a time from when the fixing device exit sensor 131 detects the trailing end of the sheet to when the trailing end of the sheet passes the switching claw 205, as a lower limit (shortest time). By setting the time T2 shorter (i.e., relatively short time T2), the power consumption of the image forming apparatus 1000 is reduced. By contrast, by setting the time T2 longer (i.e., relatively long time T2), the image forming apparatus 1000 is cooled sufficiently.

Further, in the present embodiment, the air blowing fan 124 continues to drive (blow air) until the trailing end of the sheet passes the switching claw 205, so that, even when the sheet P is not in the conveyance cooling unit 110, the air blowing fan 124 continues to blow out the cooling air from the plurality of upper conveyance passage blowout ports 21, the plurality of roller blowout ports 22, and the plurality of lower conveyance passage blowout ports 41. According to this configuration, the cooling air is blown out to the sheet ejection passage 206 and the sheet reverse passage 209, thereby cooling the conveyance guide and the pair of sheet conveying rollers provided to each of the sheet ejection passage 206 and the sheet reverse passage 209.

Conversely, each time the trailing end of the sheet passes the switching claw 205, the controller 500 may stop the driving of the air blowing fan 124 and may cause the air blowing fan 124 to start driving again to blow the cooling air when the time T1 has elapsed after the registration roller exit sensor 130 has detected the leading end of a subsequent sheet. Controlling the air blowing fan 124 to blow the cooling air as described above restrains the power consumption of the image forming apparatus 1000.

Further, in the present embodiment, the controller 500 stops driving the air blowing fan 124 after the time T2 has elapsed from detection of the trailing end of the last sheet by the fixing device exit sensor 131. Alternatively, however, the controller 500 may stop driving the air blowing fan 124 after a given time has elapsed from detection of the trailing end of the last sheet by the fixing device exit sensor 131. However, when measurement of a given time is triggered based on detection of the leading end of the last sheet by the fixing device exit sensor 131, if the controller 500 causes the air blowing fan 124 to stop driving at a timing at which the trailing end of the last sheet passes the switching claw, a timing to stop the air blowing fan 124 is set according to the length in the sheet conveyance direction of a sheet to be conveyed, thereby increasing the complexity of control of the image forming apparatus 1000. In addition, the image forming apparatus 1000 stores information of the length in the sheet conveyance direction of the sheet to be conveyed and is provided with a detector for detecting the length in the sheet conveyance direction of a sheet. Therefore, time measurement based on the detection of the trailing end of the last sheet by the fixing device exit sensor 131 is no need to change the time T2 according to the length in the sheet conveyance direction of the sheet to be conveyed. Therefore, a simpler control is performed reliably. Further, the image forming apparatus 1000 operates without a length obtaining device to obtain the length in the sheet conveyance direction of a sheet.

Further, a sheet sensor may be provided downstream from the switching claw 205 in the sheet conveyance direction, so that, when the sheet sensor detects the trailing end of the last sheet, the controller 500 causes the air blowing fan 124 to stop driving However, in the present embodiment, in order to eject the sheet with face down onto the sheet stacker 208, the sheet P is conveyed to the sheet reverse passage 209. Therefore, if a sheet sensor is provided downstream from the switching claw 205 in the sheet conveyance direction, a sheet sensor is to be provided to each of the sheet ejection passage 206 and the sheet reverse passage 209, which is likely to increase the cost of the image forming apparatus 1000.

For this reason, in the present embodiment, a sheet sensor (i.e., the fixing device exit sensor 131) is provided upstream from the switching claw 205 in the sheet conveyance direction and, after the time T2 from when the sheet sensor (the fixing device exit sensor 131) has detected the trailing end of the sheet, the controller 500 causes the air blowing fan 124 to stop driving. Accordingly, only one sheet sensor (the fixing device exit sensor 131) is provided, which reduces the number of parts and therefore achieves the reduction in cost of the image forming apparatus 1000.

Further, in the present embodiment, the controller 500 causes the air blowing fan 124 to stop driving based on detection of the trailing end of the last sheet by the fixing device exit sensor 131. However, the controller 500 may cause the air blowing fan 124 to stop driving based on detection of the trailing end of the last sheet by the registration roller exit sensor 130. Stopping the air blowing fan 124 based on detection of the trailing end of the sheet by the registration roller exit sensor 130 removes the fixing device exit sensor 131, thereby reducing the number of parts.

The configurations according to the above-descried embodiments are not limited thereto. This disclosure achieves the following aspects effectively.

Aspect 1.

A sheet conveying device (for example, the sheet conveying device 100) of Aspect 1 includes a first duct (for example, the upper air duct 115), a second duct (for example, the lower air duct 116), and a switching member (for example, the switching claw 205). The first duct is disposed facing a first face of a sheet in a sheet conveyance passage and having a first air blowing port (for example, the plurality of upper conveyance passage blowout ports 21) through which air is blown toward the sheet conveyance passage. The second duct is disposed facing a second face, as an opposite face of the first face, of the sheet in the sheet conveyance passage and having a second air blowing port (for example, the plurality of lower conveyance passage blowout ports 41) through which air is blown toward the sheet conveyance passage. The switching member is disposed downstream from the first air blowing port and the second air blowing port in a sheet conveyance direction and configured to switch the sheet conveyance passage. No pair of rollers is disposed in the sheet conveyance passage between the switching member and the first air blowing port and the second air blowing port.

According to the configuration of Aspect 1, air blown out from the first air blowout port and air blown out from the second air blowout port are flown to the switching member without being interrupted by the pair of rollers. Therefore, the air blown out from the first air blowout port and the air blown out from the second air blowout port are flown to the sheet conveyance passage to which the sheet is guided by the switching member, and therefore the conveyance guide and the pair of conveying rollers provided in the sheet conveyance passage on the side to which the switching member guides the sheet are cooled by the air blown out from the first air blowout port and the air blown out from the second air blowout port. Accordingly, an increase in temperature of the members provided downstream from each of the first air blowout port and the second air blowout port is restrained.

Aspect 2.

In Aspect 1, the switching member (for example, the switching claw 205) is configured to rotate between a first position (for example, the sheet reverse guide position) at which the sheet is guided to a first branch conveyance passage (for example, the sheet reverse passage 209) and a second position (for example, the sheet ejection guide position) at which the sheet (for example, the sheet P) is guided to a second branch conveyance passage (for example, the sheet ejection passage 206). At a position at which the first duct (for example, the upper air duct 115) faces the second duct (for example, the lower air duct 116) in the sheet conveyance passage, an edge of the switching member (for example, the edge 205*b* of the switching claw 205) is located further away than the first air blowing port (for example, the plurality of upper conveyance passage blowout ports 21) from the sheet conveyance passage when the switching member is at the first position and is located further away than the second air blowing port (for example, the plurality of lower conveyance passage blowout ports 41) from the sheet conveyance passage when the switching member is at the second position.

According to this configuration, as described in the embodiments above, the switching member such as the switching claw 205 is located at the first position such as the sheet reverse guide position, the switching member guides the sheet to the first branch conveyance passage such as the sheet reverse passage 209 and also guides the air blown out from the first air blowout port such as the plurality of upper conveyance passage blowout ports 21 to the first branch conveyance passage. The air blown out from the second blowout port such as the plurality of lower conveyance passage blowout ports 41 is guided to the sheet that is guided by the switching member, flowing to the first branch conveyance passage. Consequently, both the course of the air blown out from the first air blowout port and the course of the air blown out from the second air blowout port are the first branch conveyance passage in which the sheet is conveyed.

When the switching member is located at the second position such as the sheet ejection guide position, the switching member guides the sheet to the second branch conveyance passage such as the sheet ejection passage 206 and also guides the air blown out from the second air blowout port to the second branch conveyance passage. The air blown out from the first air blowout port is guided to the sheet that is guided by the switching member, flowing to the second branch conveyance passage. Consequently, both the course of the air blown out from the first air blowout port and the course of the air blown out from the second air blowout port are the second branch conveyance passage in which the sheet is conveyed.

Accordingly, as the switching member rotates between the first position and the second position, the course of the air blown out from the first air blowout port and the course of the air blown out from the second air blowout port are switched between the first branch conveyance passage and the second branch conveyance passage.

Aspect 3.

In Aspect 2, the first position (for example, the sheet reverse guide position) and the second position (for example, the sheet ejection guide position) are adjustable.

According to this configuration, as described in the embodiments above, the direction of flow of the air guided by the switching member such as the switching claw 205 and the sheet conveyance direction of the sheet guided by the switching member are adjusted.

Aspect 4.

In Aspect 2 or Aspect 3, the edge of the switching member (for example, the edge 205*b* of the switching claw 205) and a part of the first duct (for example, the upper air duct 115) is disposed in an alternate order in a sheet width direction when the switching member is at the first position (for example, the sheet reverse guide position) and the edge of the switching member (for example, the edge 205*b* of the switching claw 205) and a part of the second duct (for example, the lower air duct 116) is disposed in an alternate order in the sheet width direction when the switching member is at the second position (for example, the sheet ejection guide position).

According to this configuration, as described in the embodiments above, the sheet guided to the air duct is prevented from being caught by the edge of the switching member (for example, the edge 205*b* the switching claw 205), and therefore occurrence of sheet edge folding error or occurrence of sheet conveyance failure is prevented. In addition, the part of the duct (for example, plurality of ribs 116*e* in the present embodiment) that has entered the switching member blocks the flow of the air blown out from the air blowout port in the sheet width direction, flowing the air along the switching member. Accordingly, the air blown out from the air blowout port is restrained from leaking from between the duct (for example, the lower air duct 116) and the edge of the switching member such as the edge 205*b* of the switching claw 205. Accordingly, this structure prevents a decrease in the amount of flow of the air to flow into the sheet branch conveyance passage, and therefore the conveyance guide and the pair of sheet conveying rollers provided in the sheet branch conveyance passage is cooled reliably.

Aspect 5.

The sheet conveying device (for example, the sheet conveying device 100) according to any one of Aspects 1 to 4 further includes an air blower (for example, the air blowing fan 124) a sheet sensor (for example, the registration roller exit sensor 130), and circuitry (for example, the controller 500). The air blower is configured to blow air to the first duct (for example, the upper air duct 115) and the second duct (for example, the lower air duct 116).

The sheet sensor is disposed upstream from the first duct and the second duct in the sheet conveyance direction and configured to detect the sheet (for example, the sheet P) in the sheet conveyance passage. The circuitry is configured to control devices in the sheet conveying device including the air blower and the sheet sensor. The circuitry is configured to cause the air blower to start blowing air based on a detection result of the sheet sensor.

According to this configuration, as described in the embodiments above, the controller 500 starts the air blower such as the air blowing fan 124 to blow at an optional timing at which the sheet reaches a position where the first duct and the second duct are disposed facing each other.

Aspect 6.

The sheet conveying device (for example, the sheet conveying device 100) according to any one of Aspects 1 to 5 further includes an air blower (for example, the air blowing fan 124), a sheet sensor (for example, the fixing device exit sensor 131), and circuitry (for example, the controller 500). The air blower is configured to blow air to the first duct (for example, the upper air duct 115) and the second duct (for example, the lower air duct 116). The sheet sensor is disposed upstream from the switching member (for example, the switching claw 205) in the sheet conveyance direction and configured to detect the sheet (for example, the sheet P) in the sheet conveyance passage. The circuitry is configured to control devices in the sheet conveying device including the air blower and the sheet sensor. The circuitry is configured to cause the air blower to stop blowing air after a given time from detection of the sheet by the sheet sensor.

According to this configuration, as described in the embodiments above, the air blowing continues until the trailing end of the sheet passes through an air blowing range of the first duct and the second duct. Therefore, the air is blown over the entire sheet to cool the sheet.

In addition, by using a sheet detector disposed upstream from the switching member such as the switching claw 205 in the sheet conveyance direction, the number of parts is reduced, and therefore the cost of the image forming apparatus is reduced, when compared to the configuration in which a sheet detector is provided in each of the first branch conveyance passage such as the sheet reverse passage 209 and the second branch conveyance passage such as the sheet ejection passage 206.

Aspect 7.

In any one of Aspects 1 to 6, the circuitry (for example, the controller 500) changes at least one of an amount of air blown out from the first air blowing port (for example, the plurality of upper conveyance passage blowout ports 21) and an amount of air blown out from the second air blowing port (for example, the plurality of lower conveyance passage blowout ports 41) according to a type of the sheet (for example, the sheet P).

According to this configuration, as described in the embodiments above, the amount of flow of air is increased when handling a sheet type that causes toner blocking easily, such as a coated paper, and therefore the sheet is more cooled than a regular type of sheet, thereby preventing the toner blocking. When handling a sheet type that does not cause toner blocking easily, such as a non-coated paper, the amount of flow of air is decreased, and therefore the power consumption is reduced.

Aspect 8.

In any one of Aspects 1 to 7, the circuitry (for example, the controller 500) changes at least one of an amount of air blown out from the first air blowing port (for example, the plurality of upper conveyance passage blowout ports 21) and an amount of air blown out from the second air blowing port (for example, the plurality of lower conveyance passage blowout ports 41) according to whether the printing mode is a single-side printing or a duplex printing. According to this configuration, as described in the embodiments above, the amount of flow of air in the duplex printing is increased to be greater than the amount of flow of air in the single-side printing, and therefore occurrence of toner blocking in the duplex printing is restrained reliably and the power consumption in the single-side printing is reduced.

Aspect 9.

An image forming apparatus (for example, the image forming apparatus 1000) of Aspect 9 includes an image (for example, the image forming device 2) configured to form an image on a sheet (for example, the sheet P), and an sheet conveying device (for example, the sheet conveying device 100) of any one of Aspects 1 to 8, configured to convey the sheet from the image forming device.

According to this configuration, as described in the embodiments above, occurrence of toner blocking is restrained.

Aspect 10.

A sheet conveying device (for example, the sheet conveying device 100) of Aspect 10 includes a first duct (for example, the upper air duct 115), a second duct (for example, the lower air duct 116), and a switching member (for example, the switching claw 205). The first duct is disposed facing a first face of a sheet (for example, the sheet P) in a sheet conveyance passage and having a first air blowing port (for example, the plurality of upper conveyance passage blowout ports 21) through which air is blown toward the sheet conveyance passage. The second duct is disposed facing a second face, as an opposite face of the first face, of the sheet in the sheet conveyance passage and having a second air blowing port (for example, the plurality of lower conveyance passage blowout ports 41) through which air is blown toward the sheet conveyance passage. The switching member is disposed downstream from the first air blowing port and the second air blowing port in a sheet conveyance direction and configured to switch the sheet conveyance passage and a course of air blown out from the first air blowing port and air blown out from the second air blowing port.

According to this configuration, the air blown out from the first air blowout port and the air blown out from the second air blowout port are flown to the sheet conveyance passage to which the sheet is guided by the switching member, and therefore the conveyance guide and the pair of conveying rollers provided in the sheet conveyance passage on the side to which the switching member guides the sheet are cooled by the air blown out from the first air blowout port and the air blown out from the second air blowout port. Accordingly, an increase in temperature of the members provided downstream from each of the first air blowout port and the second air blowout port is restrained.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a first duct disposed at a first side of a sheet conveyance passage to face a first face of a sheet passing the sheet conveyance passage, the first duct having a first air blowing port through which air is blown toward the sheet conveyance passage;

a second duct disposed at a second side of the sheet conveyance passage to face a second face, opposite the first face, of the sheet passing the sheet conveyance passage, the second duct having a second air blowing port through which air is blown toward the sheet conveyance passage; and a switching member disposed downstream from the first air blowing port and the second air blowing port in a sheet conveyance direction and configured to switch the sheet conveyance passage, no roller being disposed between the switching member and each of the first air blowing port and the second air blowing port;

wherein the second duct includes a plurality of ribs at a downstream end in the sheet conveyance direction disposed in a sheet width direction;

wherein the second air blowing port includes a plurality of second blowout ports disposed between adjacent ribs of the ribs of the second duct;

wherein the switching member is configured to move between a first position at which the sheet is guided to a first branch conveyance passage and a second position at which the sheet is guided to a second branch conveyance passage;

wherein the switching member includes an edge on an upstream side in the sheet conveyance direction having a shape with a plurality of recesses disposed at intervals in the sheet width direction; and wherein when the switching member is at the second position, the edge of the switching member enters between the ribs of the second duct.

2. The sheet conveying device according to claim 1, wherein the switching member is configured to rotate between the first position and the second position, and wherein, at a position at which the first duct faces the second duct in the sheet conveyance passage, the edge of the switching member is located further away than the first air blowing port from the sheet conveyance passage when the switching member is at the second position and is located further away than the second air blowing port from the sheet conveyance passage when the switching member is at the first position.

3. The sheet conveying device according to claim 1, wherein the first position and the second position are adjustable.

4. The sheet conveying device according to claim 1, wherein the first duct includes a plurality of ribs at a downstream end in the sheet conveyance direction disposed in the sheet width direction;

wherein the first air blowing port includes a plurality of first blowout ports disposed between adjacent ribs of the ribs of the first duct; and wherein when the switching member is at the first position, the edge of the switching member enters between the ribs of the first duct.

5. The sheet conveying device according to claim 1, further comprising:

an air blower configured to blow air to the first duct and the second duct;

a sheet sensor disposed upstream from the first duct and the second duct in the sheet conveyance direction and configured to detect the sheet in the sheet conveyance passage; and circuitry configured to cause the air blower to start blowing air based on a detection result of the sheet sensor.

6. The sheet conveying device according to claim 5, further comprising another sheet sensor disposed upstream from the switching member in the sheet conveyance direction and configured to detect the sheet in the sheet conveyance passage, wherein the circuitry is configured to cause the air blower to stop blowing air after a given time from detection of the sheet by said another sheet sensor.

7. The sheet conveying device according to claim 5, wherein the circuitry is configured to cause the air blower to stop blowing air after a given time from detection of the sheet by the sheet sensor.

8. The sheet conveying device according to claim 1, further comprising circuitry configured to change an amount of air blown out from the first air blowing port according to a type of the sheet.

9. The sheet conveying device according to claim 1, further comprising circuitry configured to change an amount of air blown out from the second air blowing port according to a type of the sheet.

10. The sheet conveying device according to claim 1, further comprising circuitry configured to change an amount of air blown out from the first air blowing port according to whether a printing mode is a single-side printing or a duplex printing.

11. The sheet conveying device according to claim 1, further comprising circuitry configured to change an amount of air blown out from the second air blowing port according to whether a printing mode is a single-side printing or a duplex printing.

12. The sheet conveying device according to claim 1, further comprising:

an air blower configured to blow air to the first duct and the second duct;

a sheet sensor disposed upstream from the switching member in the sheet conveyance direction and configured to detect the sheet in the sheet conveyance passage; and circuitry configured to cause the air blower to stop blowing air after a given time from detection of the sheet by the sheet sensor.

13. An image forming apparatus comprising:

an image forming device configured to form an image on the sheet; and the sheet conveying device according to claim 1, configured to convey the sheet from the image forming device.

14. The sheet conveying device according to claim 1, wherein the first duct includes a roller blowout port facing a sheet conveying roller to blow out the air toward the sheet conveying roller; and wherein the sheet conveying roller is disposed upstream from the first duct and the second duct in the sheet conveyance direction.

15. The sheet conveying device according to claim 1, wherein the first air blowing port directs the air blown out toward the sheet conveyance passage and toward a sheet ejection unit downstream from the switching member in the sheet conveyance direction.

16. The sheet conveying device according to claim 15, wherein the second air flowing port directs the air blown toward the sheet conveyance passage and toward the sheet ejection unit downstream from the switching member.

17. A sheet conveying device comprising:

a first duct disposed at a first side of a sheet conveyance passage to face a first face of a sheet passing the sheet conveyance passage, the first duct having a first air blowing port through which air is blown toward the sheet conveyance passage;

a second duct disposed at a second side of the sheet conveyance passage to face a second face, opposite the first face, of the sheet passing the sheet conveyance passage, the second duct having a second air blowing port through which air is blown toward the sheet conveyance passage; and a switching member disposed downstream from the first air blowing port and the second air blowing port in a sheet conveyance direction and configured to switch the sheet conveyance passage and a course of each of the air blown out from the first air blowing port and the air blown out from the second air blowing port;

wherein the second duct includes a plurality of ribs at a downstream end in the sheet conveyance direction disposed in a sheet width direction;

wherein the second air blowing port includes a plurality of second blowout ports disposed between adjacent ribs of the ribs of the second duct;

wherein the switching member is configured to move between a first position at which the sheet is guided to a first branch conveyance passage and a second position at which the sheet is guided to a second branch conveyance passage;

wherein the switching member includes an edge on an upstream side in the sheet conveyance direction having a shape with a plurality of recesses disposed at intervals in the sheet width direction; and wherein when the switching member is at the second position, the edge of the switching member enters between the ribs of the second duct.

18. An image forming apparatus comprising:

an image forming device configured to form an image on the sheet; and the sheet conveying device according to claim 17, configured to convey the sheet from the image forming device.

19. The sheet conveying device according to claim 17, wherein the first duct includes a plurality of ribs at a downstream end in the sheet conveyance direction disposed in the sheet width direction;

wherein the first air blowing port includes a plurality of first blowout ports disposed between adjacent ribs of the ribs of the first duct; and wherein when the switching member is at the first position, the edge of the switching member enters between the ribs of the first duct.

20. The sheet conveying device according to claim 17, wherein the first duct includes a roller blowout port facing a sheet conveying roller to blow out the air toward the sheet conveying roller; and wherein the sheet conveying roller is disposed upstream from the first duct and the second duct in the sheet conveyance direction.

* * * * *